US008657631B2

(12) United States Patent
Lang et al.

(10) Patent No.: US 8,657,631 B2
(45) Date of Patent: Feb. 25, 2014

(54) VERTICAL CONNECTOR FOR A PRINTED CIRCUIT BOARD

(75) Inventors: Harold Keith Lang, Cary, IL (US); Kent E. Regnier, Lombard, IL (US); John Jantelezio, Oswego, IL (US)

(73) Assignee: Molex Incorporated, Lisle, IL (US)

( * ) Notice: Subject to any disclaimer, the term of this patent is extended or adjusted under 35 U.S.C. 154(b) by 170 days.

(21) Appl. No.: 13/201,802

(22) PCT Filed: Feb. 18, 2010

(86) PCT No.: PCT/US2010/024598

§ 371 (c)(1), (2), (4) Date: Oct. 25, 2011

(87) PCT Pub. No.: WO2010/096567

PCT Pub. Date: Aug. 26, 2010

(65) Prior Publication Data

US 2012/0034820 A1 Feb. 9, 2012

Related U.S. Application Data

(60) Provisional application No. 61/153,579, filed on Feb. 18, 2009, provisional application No. 61/170,956, filed on Apr. 20, 2009, provisional application No. 61/171,037, filed on Apr. 20, 2009, provisional application No. 61/171,006, filed on Apr. 20, 2009.

(51) Int. Cl.
*H01R 24/00* (2011.01)

(52) U.S. Cl.
USPC ..... 439/660; 439/607.08

(58) Field of Classification Search
USPC ..... 439/660, 79–83, 607.06–607.16
See application file for complete search history.

(56) References Cited

U.S. PATENT DOCUMENTS

| | | | | |
|---|---|---|---|---|
| 5,082,459 | A * | 1/1992 | Billman et al. | 439/637 |
| 5,213,514 | A | 5/1993 | Arai | |
| 5,360,346 | A * | 11/1994 | Regnier | 439/61 |
| 5,378,175 | A * | 1/1995 | Regnier | 439/733.1 |
| 6,551,140 | B2 * | 4/2003 | Billman et al. | 439/607.07 |

(Continued)

FOREIGN PATENT DOCUMENTS

| | | |
|---|---|---|
| EP | 1 758 209 A2 | 2/2007 |
| JP | 04-272676 | 9/1992 |

(Continued)

OTHER PUBLICATIONS

International Search Report for PCT/US2010/024598.

(Continued)

*Primary Examiner* — Amy Cohen Johnson
*Assistant Examiner* — Vladimir Imas
(74) *Attorney, Agent, or Firm* — Stephen L. Sheldon

(57) ABSTRACT

An connector assembly is provided that may be utilized for vertical applications on a circuit board. The assembly includes a housing that supports a plurality of wafers that in tern support a plurality of terminals. The housing includes a base and a nose and can have two slots in the nose and the terminals extend to both slots. A guide frame can be positioned on the housing to help support the housing. The terminals can be arranged in a row on both sides of the two slots. The tails of the terminals can be configured with respect to the slots so as to provide desirable performance.

16 Claims, 21 Drawing Sheets

(56) References Cited

U.S. PATENT DOCUMENTS

| | | | | |
|---|---|---|---|---|
| 6,602,095 | B2 * | 8/2003 | Astbury et al. | 439/607.07 |
| 6,688,895 | B1 * | 2/2004 | Fan | 439/82 |
| 6,884,117 | B2 * | 4/2005 | Korsunsky et al. | 439/607.11 |
| 7,074,086 | B2 * | 7/2006 | Cohen et al. | 439/607.08 |
| 7,794,240 | B2 * | 9/2010 | Cohen et al. | 439/78 |
| 7,794,278 | B2 * | 9/2010 | Cohen et al. | 439/607.09 |
| 7,914,305 | B2 * | 3/2011 | Amleshi et al. | 439/101 |
| 7,963,806 | B1 * | 6/2011 | Kline et al. | 439/660 |
| 8,187,034 | B2 * | 5/2012 | Fedder et al. | 439/607.01 |
| 8,226,441 | B2 * | 7/2012 | Regnier et al. | 439/626 |
| 8,342,888 | B2 * | 1/2013 | Amleshi et al. | 439/676 |
| 2002/0098724 | A1 * | 7/2002 | Cohen et al. | 439/80 |
| 2004/0077192 | A1 * | 4/2004 | Guglhoer | 439/79 |
| 2005/0181673 | A1 * | 8/2005 | D'Ambrosia et al. | 439/608 |
| 2006/0189212 | A1 * | 8/2006 | Avery et al. | 439/608 |
| 2008/0248659 | A1 * | 10/2008 | Cohen et al. | 439/59 |
| 2009/0170373 | A1 * | 7/2009 | Pan | 439/607.36 |
| 2011/0300757 | A1 * | 12/2011 | Regnier et al. | 439/626 |

FOREIGN PATENT DOCUMENTS

| | | |
|---|---|---|
| JP | 2000-357549 | 12/2000 |
| JP | 2007-213844 | 8/2007 |
| WO | 03/094304 A1 | 11/2003 |

OTHER PUBLICATIONS

International Search Report for PCT/US2010/024598, 2010.

* cited by examiner

FIG.2C
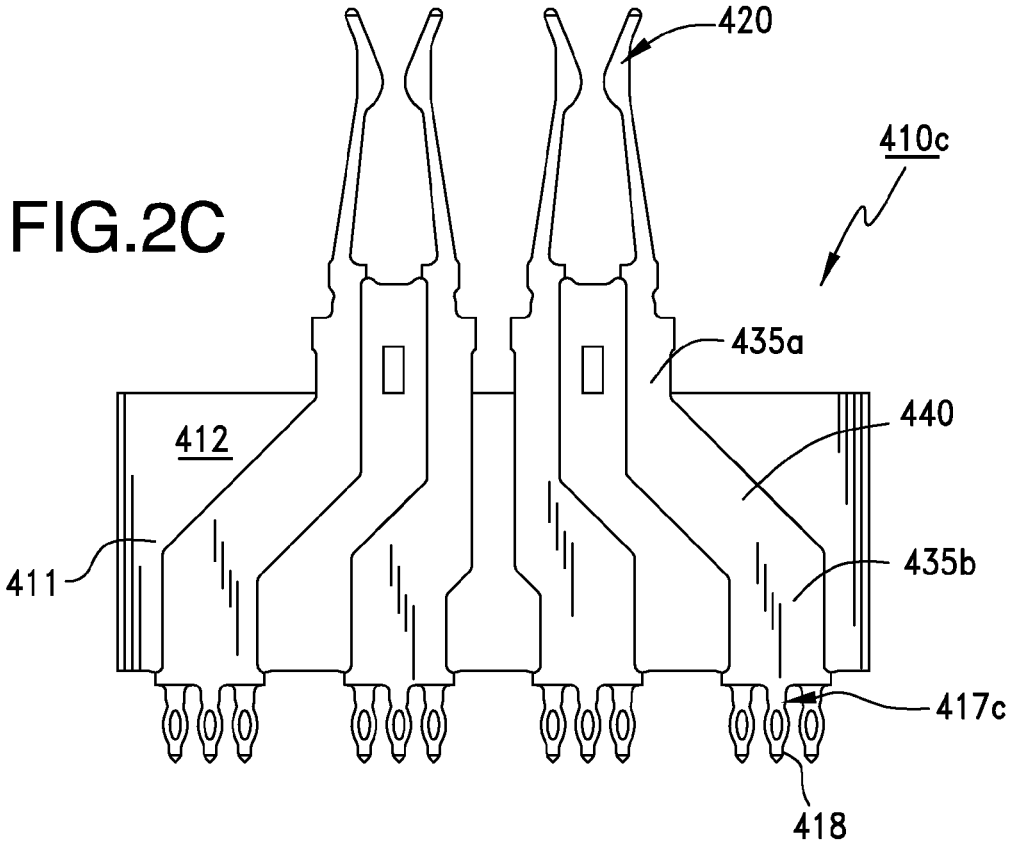
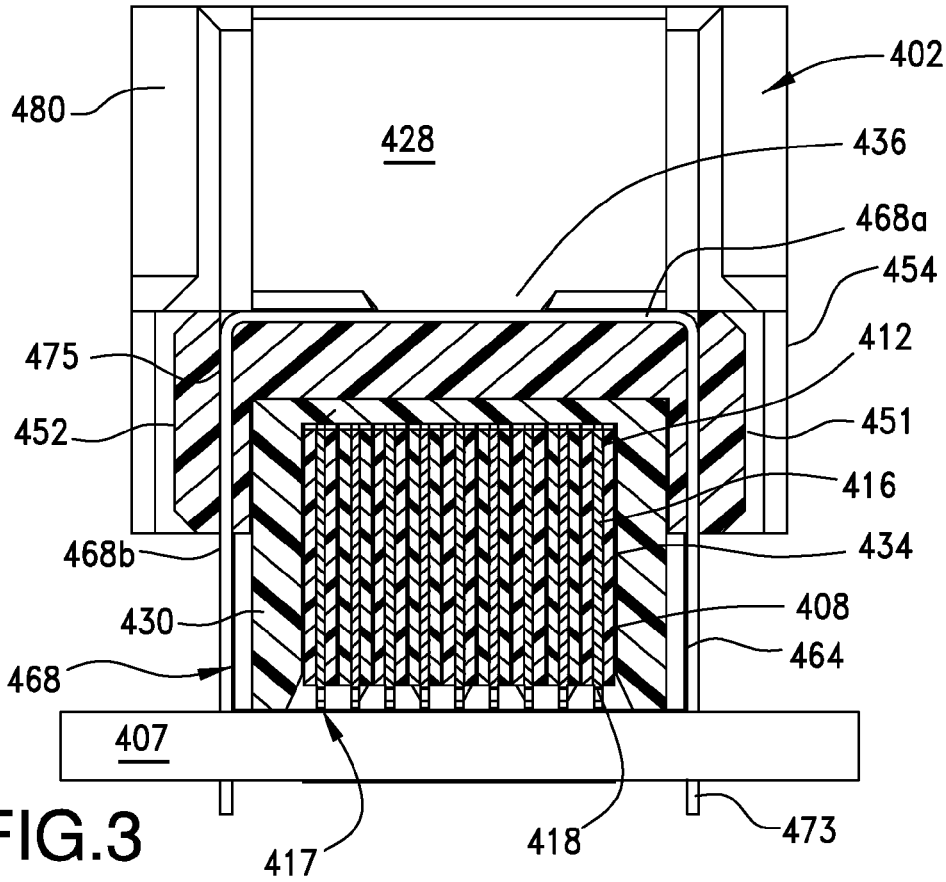
FIG.3

VERTICAL CONNECTOR FOR A PRINTED CIRCUIT BOARD

REFERENCE TO RELATED APPLICATIONS

This application claims priority to PCT Application No. PCT/US2010/024598, filed Feb. 18, 2010, which in turn claims priority to Provisional Ser. Appln. No. 61/153,579, filed Feb. 18, 2009, to Appln. No. 61/170,956 filed Apr. 20, 2009, to Appln. No. 61/171,037, filed Apr. 20, 2009 and to Appln. No. 61/171,066, filed Apr. 20, 2009, all of which are incorporated herein by reference in their entirety.

BACKGROUND OF THE INVENTION

The present disclosure generally relates to connectors suitable for transmitting data, more specifically to input/output (I/O) connectors suitable for dense connector configurations.

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

I/O connectors may be used in "internal" applications, for example, within electronic devices, such as routers and servers here an I/O connector and its mating plug connector are entirely enclosed within a component such as a router, server, switch or the like, or they may be used in "external" application, where they are partially enclosed within a component, but the receptacle portion of the I/O connector communicates to the exterior of the component so that a plug connector may be used to connector that I/O connector to other components. Most I/O connectors utilize a horizontal format, meaning their mating faces are perpendicular to the circuit board upon which they are mounted. As such, they require an additional I/O connector near the exit point of the device in which they are used, which adds cost and restrains the designer. The different designs used in the internal and external connectors tend to raise cost and a need exists for an economical high performance connector.

SUMMARY OF THE INVENTION

A vertical connector for mounting on a circuit board includes a plurality of terminal assemblies in the form of wafers that are received within a housing. Each wafer includes an insulative frame that supports multiple terminals so as to provide terminals that are positioned in at least two edge card-receiving slots. The connector utilizes pairs of differential signal terminals that are arranged so as to be broadside coupled within the connector housing from their contact portions to proximate their tail portions. The housing with a base and a nose. At least two edge card-receiving slots are disposed in the nose and the terminal contact portions of the signal and ground terminals can be arranged on opposing sides of each slot so as to contact corresponding contact pads arranged on both sides of each of the edge cards when an opposing connector is mated to the vertical connector. In an embodiment, the terminals positioned on one slide of each slot can terminate as three rows of tails with ground terminals positioned in the middle row. In an embodiment, the card edge of two adjacent card slots will be arranged with respect to at least one center row of terminals.

In an embodiment, the connector can include a guide frame that fits onto the nose to help guide an opposing, mating plug connector into engagement with the vertical connector. The nose can include one or more engagement members on a surface thereof that is engageable with corresponding, complementary engagement members on the guide frame. The guide frame can be a hollow frame member having four sides interconnected together to define an opening in the frame. This opening fits over the nose and the guide frame can be provided with an inner ledge proximate to the opening so that a portion of the guide frame fits over the housing and the inner ledge thereof abuts the shoulders of the housing. In an embodiment, the guide frame can be attached to the circuit board via one or more straps.

In another embodiment, the connector can include a cage. To provide for thermal management, a heat sink can be mounted on one side of the cage and in an embodiment the heat sink can be configured to at least partially cover three sides of the cage.

BRIEF DESCRIPTION OF THE DRAWINGS

Throughout the course of the following detailed description, reference will be made to the drawings in which like reference numbers identify like parts and in which:

FIG. 2C is a side elevational view of a ground terminal assembly associated with pairs of differential signal terminal assemblies used in the connector of FIG. 1;

FIG. 3 is a widthwise sectional view of the connector-guide assembly of FIG. 1, taken along lines 3-3 thereof;

DETAILED DESCRIPTION OF THE ILLUSTRATED EMBODIMENTS

As required, detailed embodiments are disclosed herein; however, it is to be understood that the disclosed embodiments are merely exemplary and may be embodied in various forms. Therefore, specific details disclosed herein are not to be interpreted as limiting, but merely as a basis for the claims and as a representative basis for teaching one skilled in the art to variously employ the disclosure in an appropriate manner, including employing various features disclosed herein in combinations that might not be explicitly disclosed herein.

It has been determined to be desirable to have an I/O connector with structure that permits it to be used in multiple applications, so as to reduce manufacturing costs and the need to maintain multiple connector products to fit multiple applications. It also has been determined to be desirable to utilize an I/O connector in place of a backplane connector to permit a connection from the mother board of a first device to a second device by running a cable directly from the vertical connector to the second device. This is believed to be particularly beneficial for vertical connectors that are capable of providing greater than 15 Gbps data rates and is even more beneficial for connectors that can data rates that exceed 20 Gbps.

Figure 1:
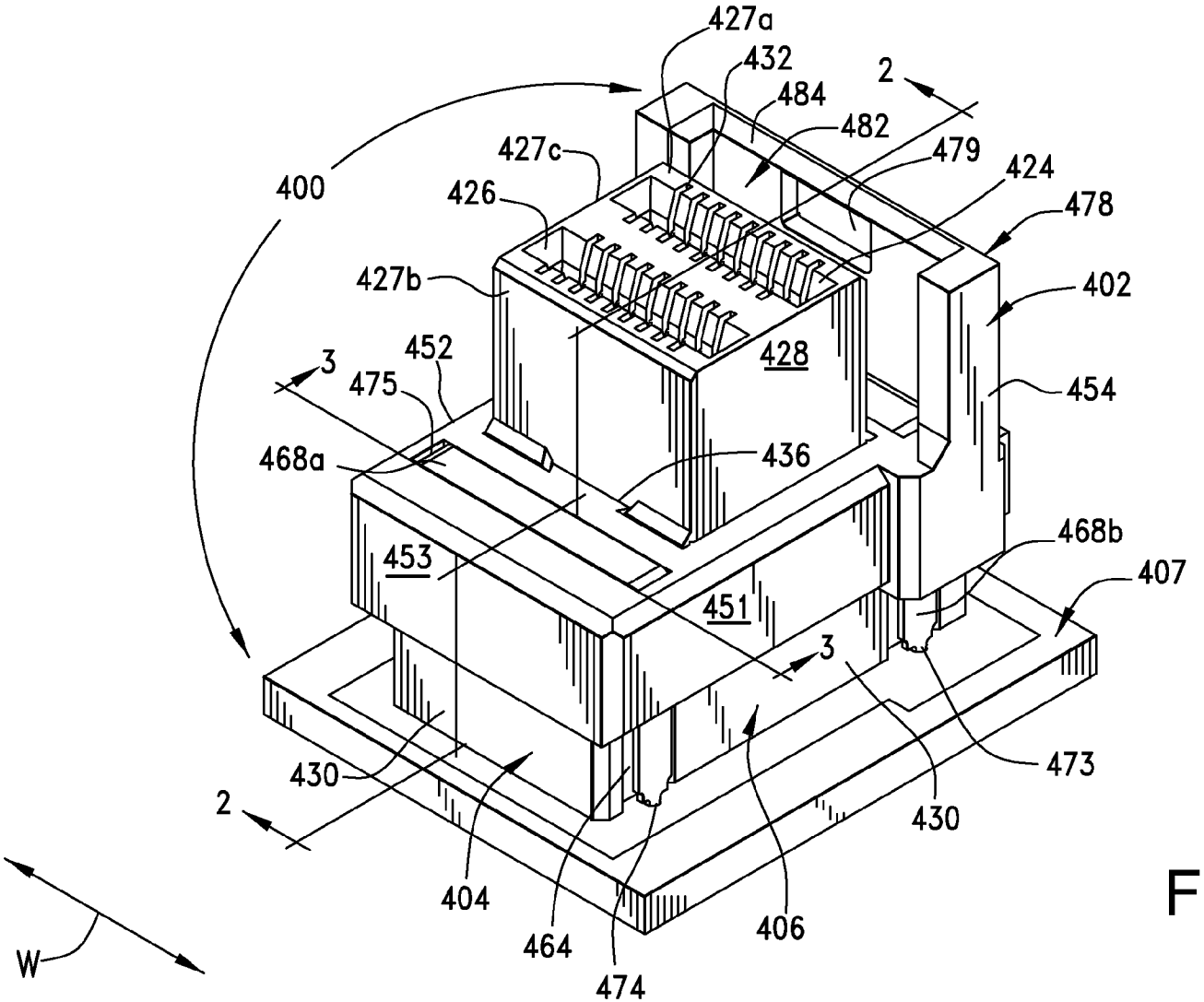
FIG. 1 is a perspective view of one embodiment of a vertical I/O connector which is provided with a guide assembly for internal, guided cable applications.
Figure 2:
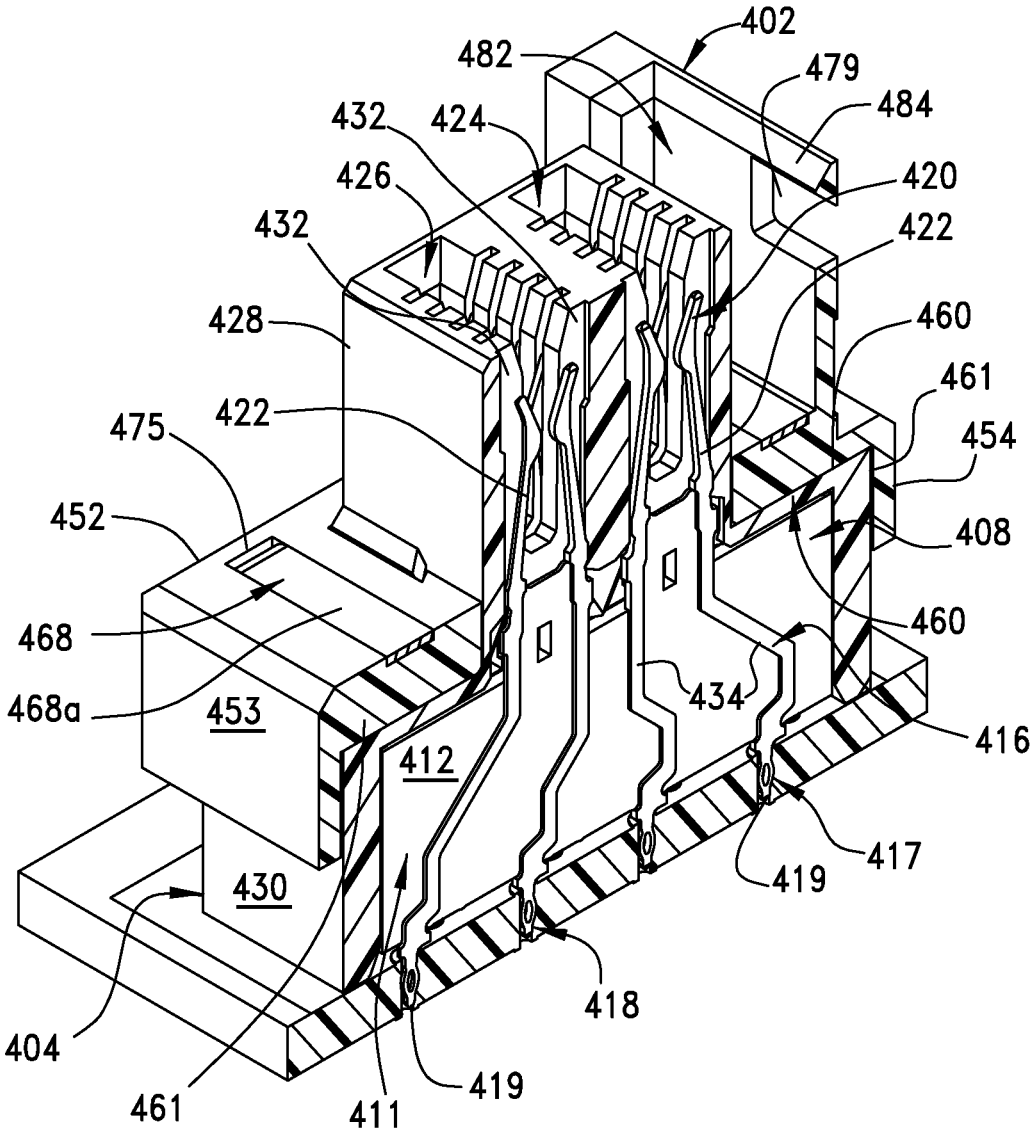
FIG. 2 is a lengthwise sectional view of the connector-guide assembly of FIG. 1, taken along lines 2-2 thereof.
Figure 4:
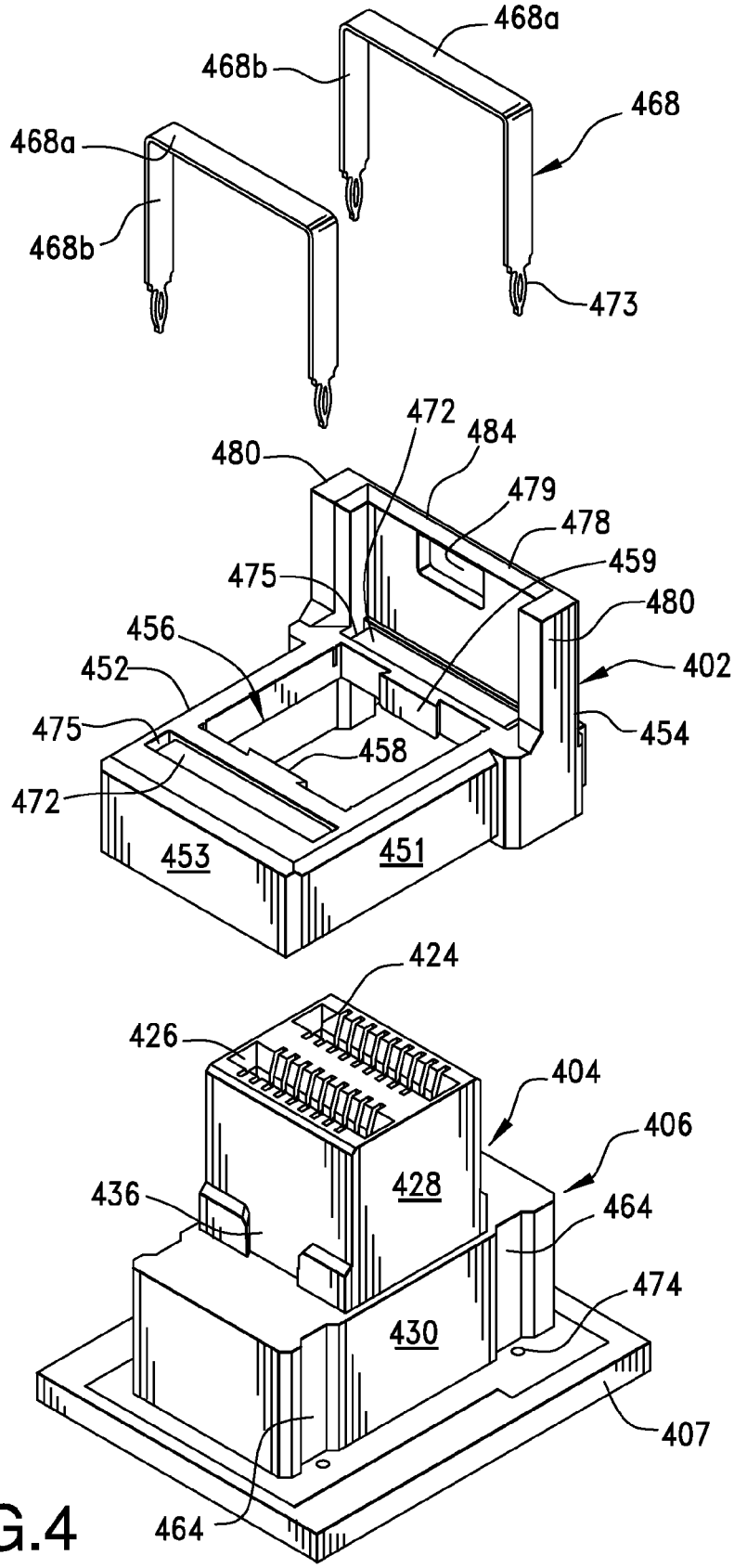
FIG. 4 is an exploded view of the connector-guider assembly of FIG. 1.
Figure 5:
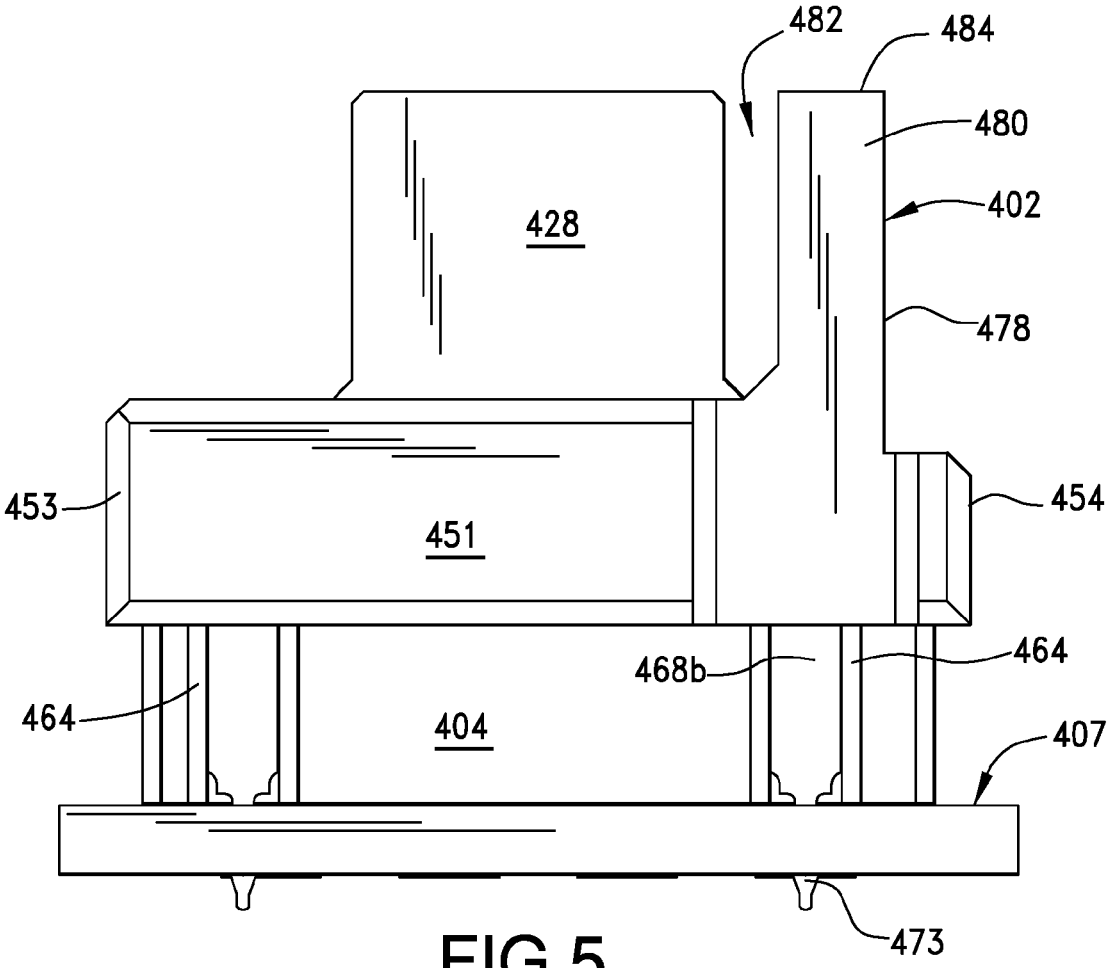
FIG. 5 is an elevational view of the right side of the connector guide assembly of FIG. 1.
Figure 6:
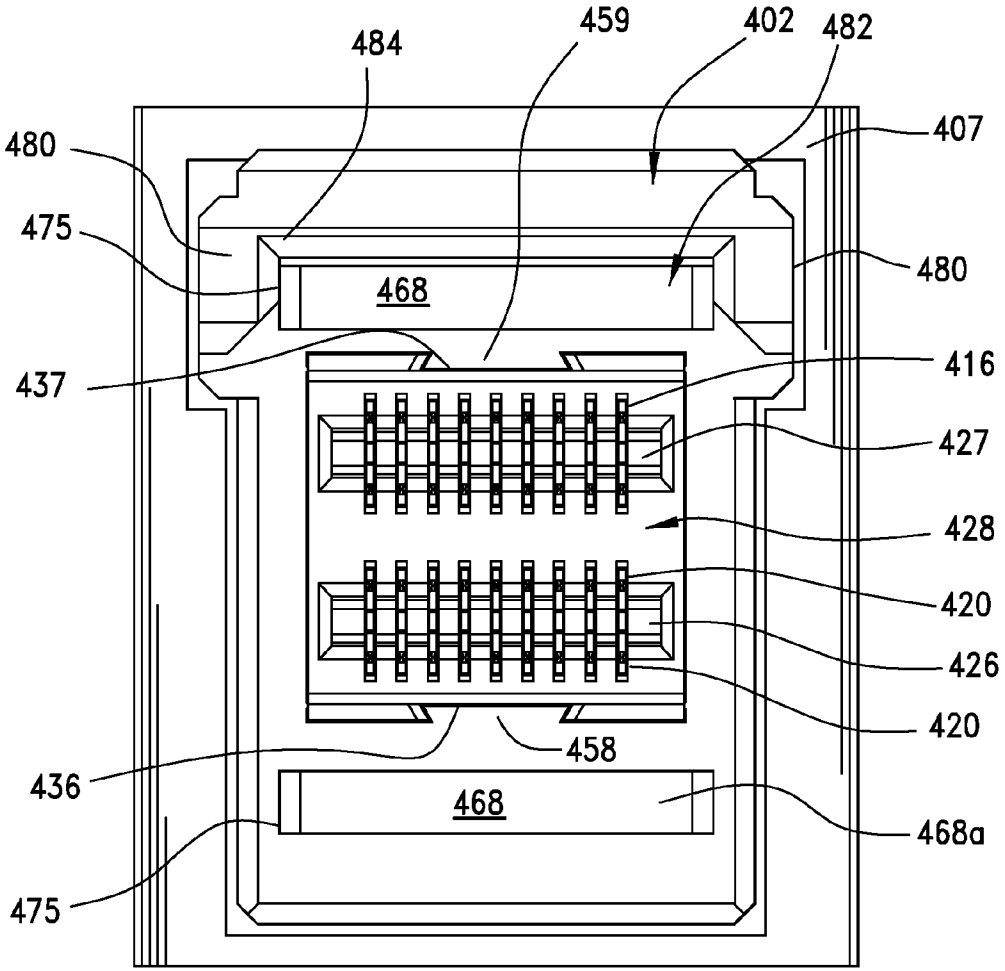
FIG. 6 is a top plan view of the connector-guide assembly of FIG. 1, illustrating the manner of engagement between the vertical connector and its associated guide frame.

FIGS. 1-8 illustrate an embodiment of a connector assembly 400 for vertical applications that includes a separate guide member 402 that engages a housing 404 of a vertical connector 406 which is mounted to a printed circuit board 407. As illustrated in FIGS. 2 and 4, the housing 404 is formed in vertical configuration with a plurality of walls 405, which cooperatively define an interior space 408. The interior space 408 accommodates a plurality of terminal assemblies 410. The terminal assemblies 410 are shown in the form of wafers 412 with an insulative frame 414 that supports a plurality of conductive terminals 416. The depicted wafers 412 include four terminals for a two card slot configuration provided by the housing 404 and each terminal 416 includes a tail 417 at one end thereof, preferably in the form of a compliant pin 418 that is received within a plated via 419 formed in the circuit board 407. At the opposite end, each terminal 416 includes a contact 420, which is depicted as a cantilevered contact beam 422. Pairs of the terminals are shown disposed on opposite sides of two slots 424, 426 of the housing 404. These slots 424, 426 (which are sometimes referred to as edge card-receive slots) are disposed on a mating face 429 of a nose 428 of the housing 404 that projects, as shown best in FIGS. 1 and 2D, upwardly from a base 430. The wafers 412 are inserted into the interior space 408 of the housing 404 in a side-by-side arrangement so that the contact 420 is held in a respective channel 432 on opposite sides of each card-receiving slot 424, 426. As noted in greater detail below, this side-by-side arrangement allows for broadside coupling of the signal pairs of the connector. The contact 420 of each terminal can make contact with a contact pad on a card (sometimes referred to as a paddle card) that is inserted into the slot when the vertical connector 406 is mated to an opposing plug connector.

The contact and tail 420, 417 are interconnected by a body 434 over which the insulative frame 414 may be molded. The housing 404 as illustrated has a general inverted T-shape, with the base 430 being larger and surrounding and supporting the nose 428. As depicted, the base 430 has shoulders 462 that flank the nose 428 and these shoulders 462 are wide at the front and rear portions of the connector housing 404 and narrow along the sides of the connector housing 404. This allows the wafer 412 to have a wide base 411 that extends between sidewalls 405 of the housing 404. The wafer 412 can also include two vertical portions 413 that extend upward and help direct the pair of terminals 416 into each slot, which helps secure the corresponding contact in vertical cantilevered fashion.

Each wafer 412 can support two pairs of terminals (such as pair 416*a*), with each pair being associated with one of the slots 424, 426 and the contacts 420 of each such terminal pair being disposed on opposite sides of the slot 424, 426 in respective terminal-receiving cavities 425. These cavities 425 may be wider at their top portions as shown in order to provide for a full range of deflection of the contact when a mating edge card is inserted into the slot 424, 426. The slots 424, 426 are defined, at least in part, by a first and second sidewall 427*a*, 427*b* that are spaced apart from each other and that extend vertically within the nose 428. As shown best in FIG. 2D, the contact 420, prior to an edge card being inserted, extends inwardly within the card slot 424, 426. The contact 420 moves outwardly within their respective cavity 425 when the edge card is inserted into the slot 424, 426. The terminals 416 of the connector housing 404 are arranged in first and second rows of terminals that extend alongside opposing sides of the slot 424, 426 as described in further detail to follow.

Figure 2A:
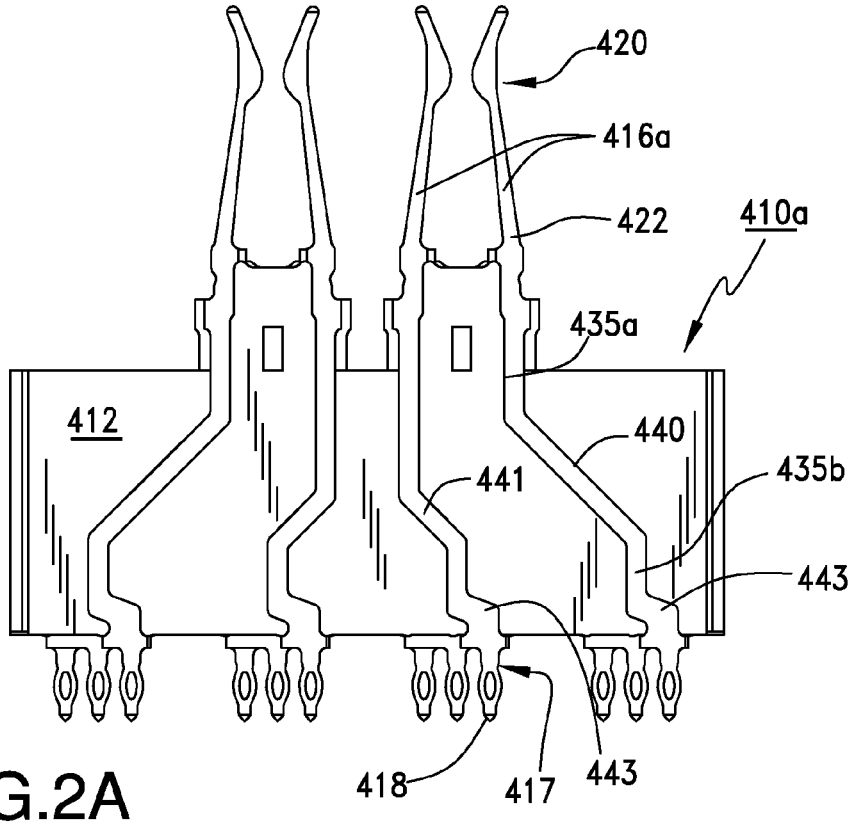
FIG. 2A is a side elevational view of a first differential signal terminal assembly utilized in the connector of the assembly shown in FIG. 1.
Figure 2B:
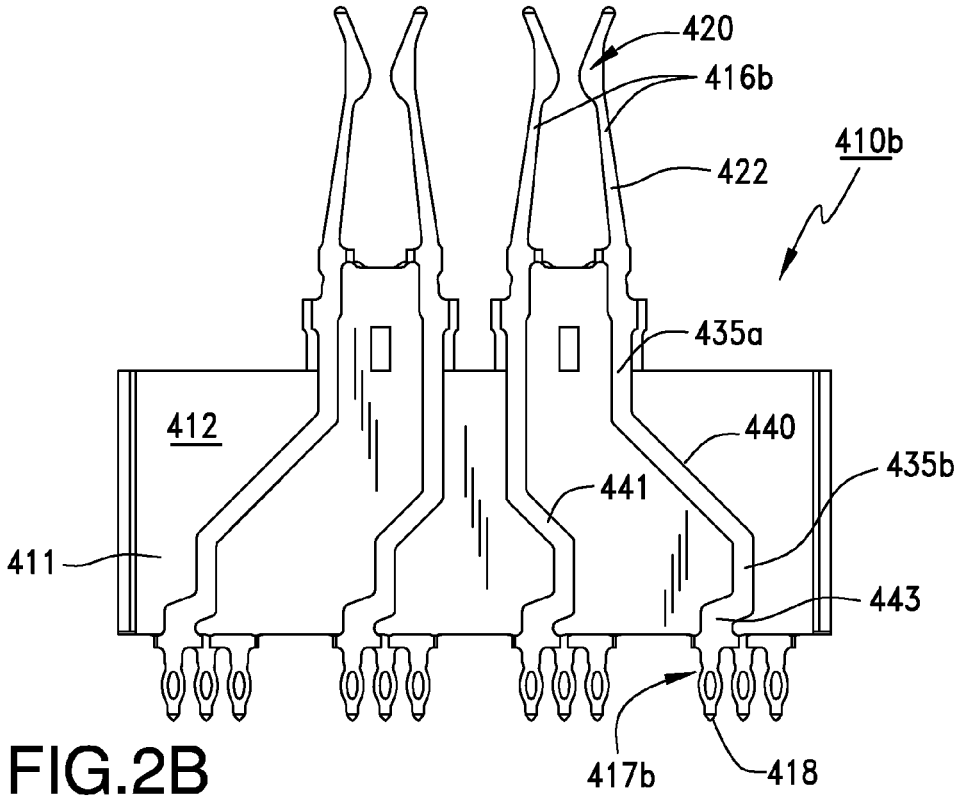
FIG. 2B is a side elevational view of a second differential signal terminal assembly that is paired with the first terminal assembly of FIG. 2A and utilized in the connector of FIG. 1.

The connector can be configured for high data rates. As such, it may include respective sets of a first signal wafer 410*a* and a second signal wafer 410*b*, which respectively support a first signal terminal 416*a* and a second signal terminal 416*b*. Positioned between two sets of signal wafers is a ground wafer 410*c*, which supports ground terminals. The terminal are thus arranged in a repeating order, widthwise, within the housing 404 in signal-signal-ground pattern with a ground terminal being interposed between pairs of signal terminals 416*a*, 416*b*. FIGS. 2A and 2B illustrate features of the first and second signal wafer 410*a*, 410*b* used in the connector housing 404 to transmit differential signal terminals, while FIG. 2C illustrates a ground wafer 410*c* that supports ground terminals. The signal terminals 416*a*, 416*b* are used to transmit differential signals between circuits on the circuit board 407 and pads disposed on an edge of a mating edge card. The ground terminal can have a body that is wider than the signal terminals and, as it is interposed between pairs of signal terminals 416*a*, 416*b*, can help provide electrical isolation between adjacent terminals (thus helping to ensure crosstalk is kept low).

The terminals are arranged in connectors to provide broadside coupling, meaning that the differential signal pairs are made up of signal terminals in adjacent wafers with the signal terminals being aligned in a widthwise direction of the connector housing as noted by the arrow "W" in FIG. 1. In other words, pairs of signal terminals confront each other from their contact portions 420 to proximate their second leg portions 435*b* so as to form a differential pair. In this manner, the adjacent signal terminals are coupled to each other in a direction perpendicular to the plane of the paper on which FIGS. 2A-2D appear. Comparing FIGS. 2A and 2B, it can be seen that the signal terminals 416*a*, 416*b* shown therein have substantially the same configuration, other than at the bottom ends of their body portions 434 where they diverge away from each other in the longitudinal direction in order to mate with a desired via pattern in the circuit board 407. As the terminals 416*a*-416*c* approach the tail portions 417, their body portions 434 diverge away from each other so that their respective tail portions are also spaced away from each other. As shown best in FIG. 2D, the signal terminal tail portions 417*a*, 417*b* of each pair are spaced on the right and left sides of the ground terminal tail portion 417*c* associated with the signal terminal pair. This is done to accommodate a pattern of respective ground and signal vias formed in the circuit board 407 which provides enough space for necessary exit traces as well as a secure mechanical connection. Thus, the embodiments depicted have differential pairs that go from a predominantly broad-side coupled signal terminals to a coupling that is includes more edge coupling. In part, this is because the use of adjacent, broadside coupled terminals (if the broadside coupling were to be maintained into the board) causes the via spacing necessary to maintain such a side-by-side arrangement to become difficult to achieve without resulting in possible severe weakening of the circuit board 407. Therefore it becomes beneficial to space the vias apart and shift toward edge-coupling so that there is sufficient space in which to drill the via patterns and still maintains the integrity of the circuit board 407.

Figure 2D:
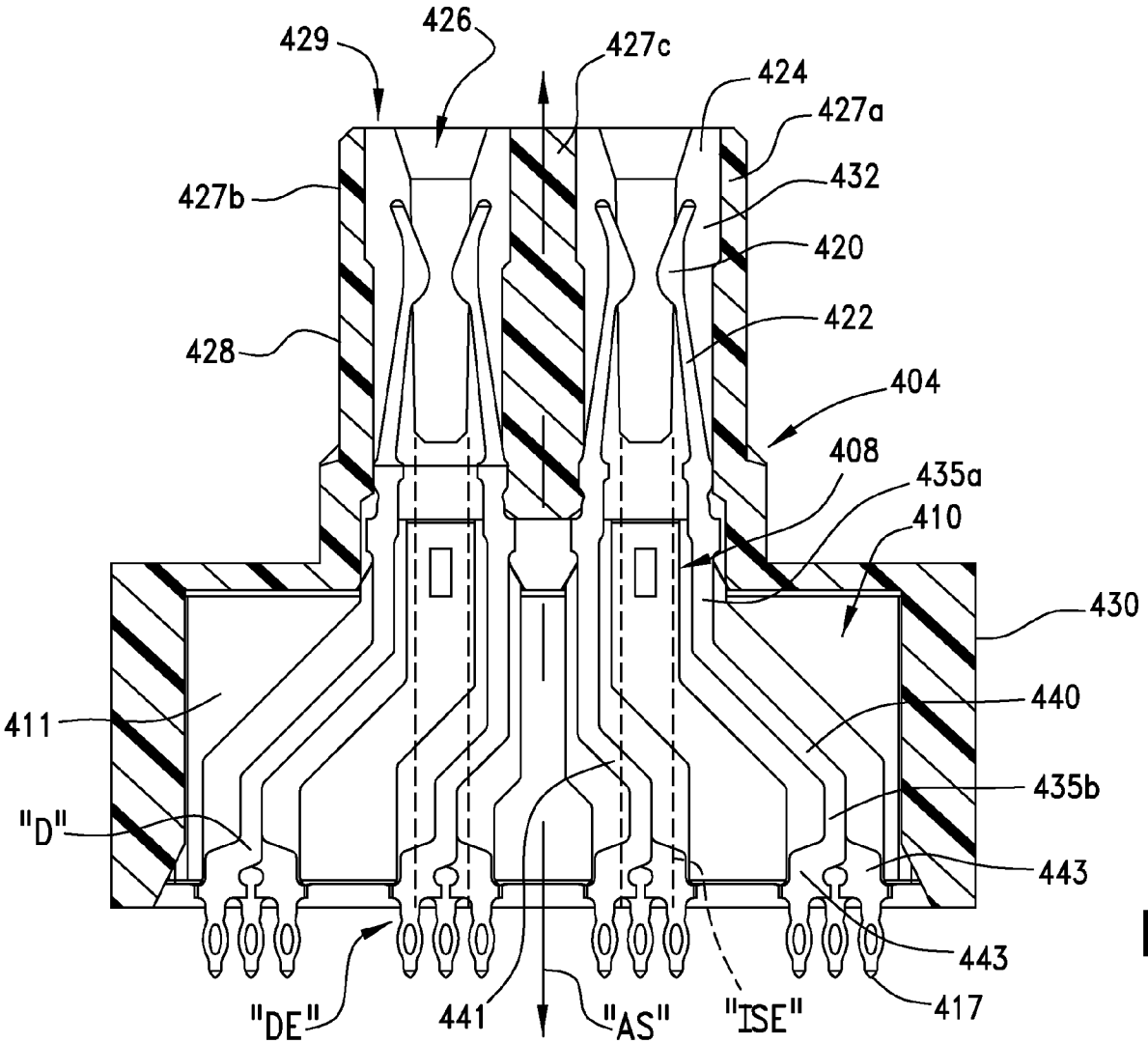
FIG. 2D is a sectional view of the vertical connector of FIG. 1, taken from a side thereof, showing the differential signal terminals of the terminal assemblies of FIGS. 2A and 2B superimposed alongside (in front) of the ground terminals to illustrate the alignment of the three sets of terminals with respect to each other.

Due to the vertical nature of the housing, the terminals 416 can be specially configured and may be considered to possess multiple distinct sections, or portions. At their topmost ends is a contact 420 which is joined to the body 434 which in turn connects the contact and tail together. The body 434 can have multiple sections such as a first leg 435*a* that is shown extending generally vertically downwardly from the contact portion 420. (FIG. 2D.) A second leg 435*b* is spaced apart from the first leg and is generally vertically oriented, and they are preferably offset from and generally parallel to the first leg 435*a*. The first and second leg 435*a*, 435*b* are joined together by a jog 440, 441 that extends at an angle to the first and second leg portions 435*a*, 435*b*. Lastly, the body 434 further includes a transition 443 that interconnect the second leg 435*b* to the tail 417. As illustrated in FIG. 2D, the transition 443 of the signal terminals diverges from the confronting relationship and extends away from each other to the associated tail 417*a*, 417*b* which, as depicted, is positioned on the right and left sides of the ground terminal tail portions 417*c* when viewed at an angle aligned with a slot width.

As can be appreciated, the transition 443 increase in width as it approaches the tail 417. This tends to increase capacitive coupling between the pair of signal terminals and can help to make up for the reduction in capacitive coupling that occurs because of the increased separation between the terminals. Consequentially, the added material helps control the impedance discontinuity that will tend to occur through the transition. Therefore, although the signal terminal contact, first and second leg and jog have a constant width, the transition can have a width which increases as the distance between the terminals increases so that the impedance of the terminals may be controlled.

The use of two slots 424, 426 in the connector housing 404 and the resultant density makes in more difficult to maintain a given level of performance. It has been determined that the depicted terminal orientation permits the size of the connector housing 404 to be kept at a minimum while providing for reduced crosstalk and skew. As such, the terminals associated with one of the card-receiving slots 424 are arranged in the connector housing such that they are substantially symmetrical with the terminals of the other card-receiving slot 426 about a vertical line, or axis, of symmetry "AS". (FIG. 2D.)

Furthermore, and to facilitate the small size of the connector housing 404, the terminal body jog 440, 441 portions are interposed between the terminal body first and second leg portions 435*a*, 435*b*. As shown in FIGS. 2A-2D, this jog extends outwardly, or away from the axis of symmetry AS (as well as the respective card slots 424, 426 associated with each signal pair of terminals). The terminals 416 may be further considered as being arranged in first and second arrays of terminals associated with each card slot 424, 426, one set being considered as "outer" terminals and the other set being considered as "inner" terminals as will become evident to follow. The outer terminals are included in the first arrays of terminals arranged along the outer sides of the card-receiving slots 424, 426, and these diverge outwardly away from the card-receiving slots and end in tail portions 417 that are located near the edges of the wafer and the sidewalls 405 of the connector housing base portion 430. The divergence of these outer signal terminals is shown at "D" on FIG. 2D.

Similarly, the inner terminals are included in the second array of terminals and are arranged along the inner (or adjacent sides) of the slots 424, 426. The inner terminals have first legs that extend further vertically than do the corresponding outer terminal first leg 435*a*. The inner terminal jog 441 extends outwardly in the same general direction as the outer terminal jog 440, as shown in FIG. 2E, outwardly away from the axis of symmetry AS, and are preferably shorter in length than the outboard terminal body jog portions 440. In order to take advantage of the space created in the wafers by the direction the jog of the outer terminals extends, the inner terminals jog in the same direction as do the outer terminals, but for a smaller distance. Preferably, as shown in FIG. 2D, this distance is preferred to be a distance such that a portion of the inner terminal body portions 434 is located directly below the respective card-receiving slot 424, 426 at "DE." Such portions, as shown in the drawings are preferably the inboard terminal body second leg portions 435*b*, where the adjacent terminals forming a differential signal terminal pair in the connector are facing each other. In an embodiment, to locate the second leg 435*b* of the inner terminals, one can extend an imaginary line, as shown at "ISE" in FIG. 2D, that is coincident with the sides 427*a*, 427*b* of the slots 424, 426 and extends down to the mounting face of the connector that confronts the circuit board 407. These lines correspond to a location of the slots 424, 426 and it can be seen that the lower portions of the inner terminals extend into this location. As depicted, for example, the second leg 435*b* and to some extent, the transition 443 is so located. Hence, for one card slot, the outer array of terminals extends away from the card slot and the inner array of terminals is configured so that one of the terminals is at least partially positioned at a point that is at least partially defined by the location of the slot.

Another embodiment of a connector assembly 700 is shown in FIGS. 11-14 and is suitable for backplane applications. A vertical connector 701 is shown as having a housing 702 with a mating face 720 that includes multiple slots 725, 726 disposed thereon, with two such slots being shown and separated by an intervening center wall, or member 727. A mounting face 721 is shown opposite the mating face for attaching the connector to a circuit board 703, and in the orientation illustrated in FIG. 12, it lies along the bottom of the connector 701, but it will be understood that the use of the term "bottom" herein is relative depending on the orientation shown. The housing 702 has a base 718 that accommodates the mounting face 721 and a nose 719 that extends upwardly from the base portion 718 terminating in the mating face 720 of the housing. The housing 702 is accommodated within a cage 704 that has a hollow interior portion 705 that is accessible for an opposing mating connector (not shown) by way of a mating opening 706. The cage 704 can further include an ancillary opening 708 that can accommodate a heat sink member 710 that can be so mounted and can be held in position by a pair of engagement lugs 717 and a retention member, such as a clip 711, that as depicted overlies the heat sink 710 and the cage 704. The mating opening 706 of the guide housing 704 may be provided, as illustrated, with an EMI gasket assembly which can include spring contacts 712*a*, 712*b* and a conductive, compressible gasket 713.

Figure 14:
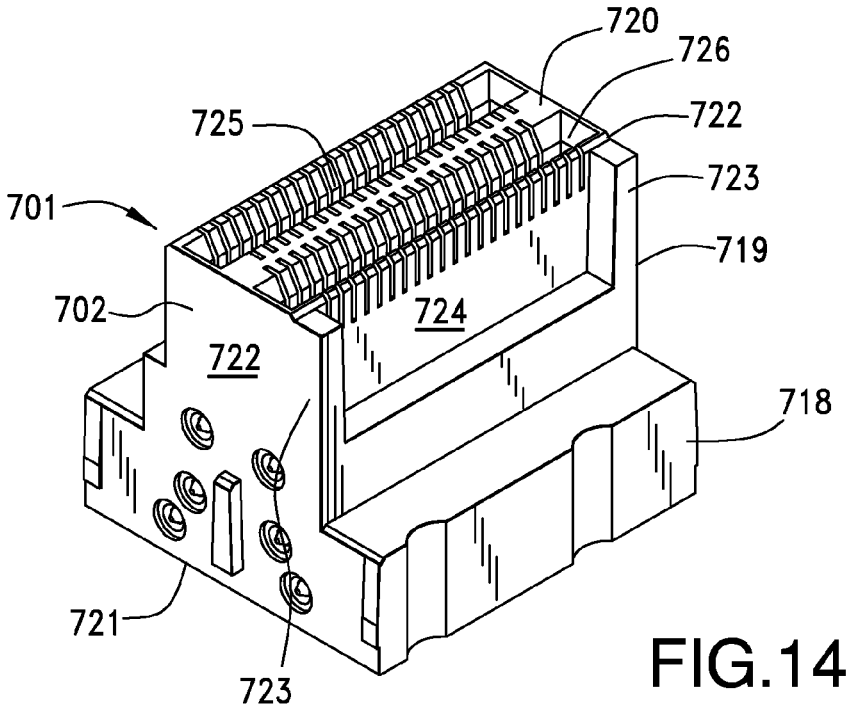
FIG. 14 is a perspective view of the vertical connector used in the connector assembly of FIG. 11.

The housing 702 is received in the cage 704, and as noted from the drawings, the housing 702 can have an asymmetrical shape, which can help assure the housing is assembled in the proper orientation within the cage 704. In this regard, the cage 704 can be provided with a notch 730 along its inner surface that receives a pair of end wall extensions 723 of the connector housing 702. The extensions 723 are spaced apart from each other, and as shown in FIG. 14, include an intervening space therebetween. This space defines a guide channel 734 on one side of the connector 701 that is dimensioned to receive a guide flange of an opposing mating connector. The heat sink 710 includes a plurality of individual heat dissipating members that extend up form a base portion of the heat sink which partially projects into the hollow interior 705 of the exterior guide housing 704 in general opposition to the nose portion 719. The bottom surface 715 of the heat sink 710 is spaced apart from the nose portion 719 so as to define an intervening space therebetween that serves as an additional guide channel 732 into which a guide flange of the opposing mating connector may project when the two connectors are mated together. The insertion of the connector housing 702 into the exterior guide housing 704 forms these two guide channels 732, 734.

As in the above, previously described embodiment, the housing 702 contains a plurality of conductive terminals in wafers. The terminals are arranged in two arrays for each such card-receiving slot 725, 726 and each array extends alongside opposing sides of the slots 725, 726 so that the contact portions 746 of the terminals will contact circuits on opposing sides of a mating edge card that are part of a mating connector (not shown). The wafers include signal wafers 736 & 738 (FIGS. 14A & 14B) and a ground wafer 740. (FIG. 14C.) The wafers are arranged within the housing so that the two signal wafers 736, 738 are adjacent each other to allow for the formation of differential signal pairs and pairs of these signal wafers are separated by intervening ground wafers. The terminals of the signal and ground terminal assemblies are held in place by a supporting frame 741.

Figure 14A:
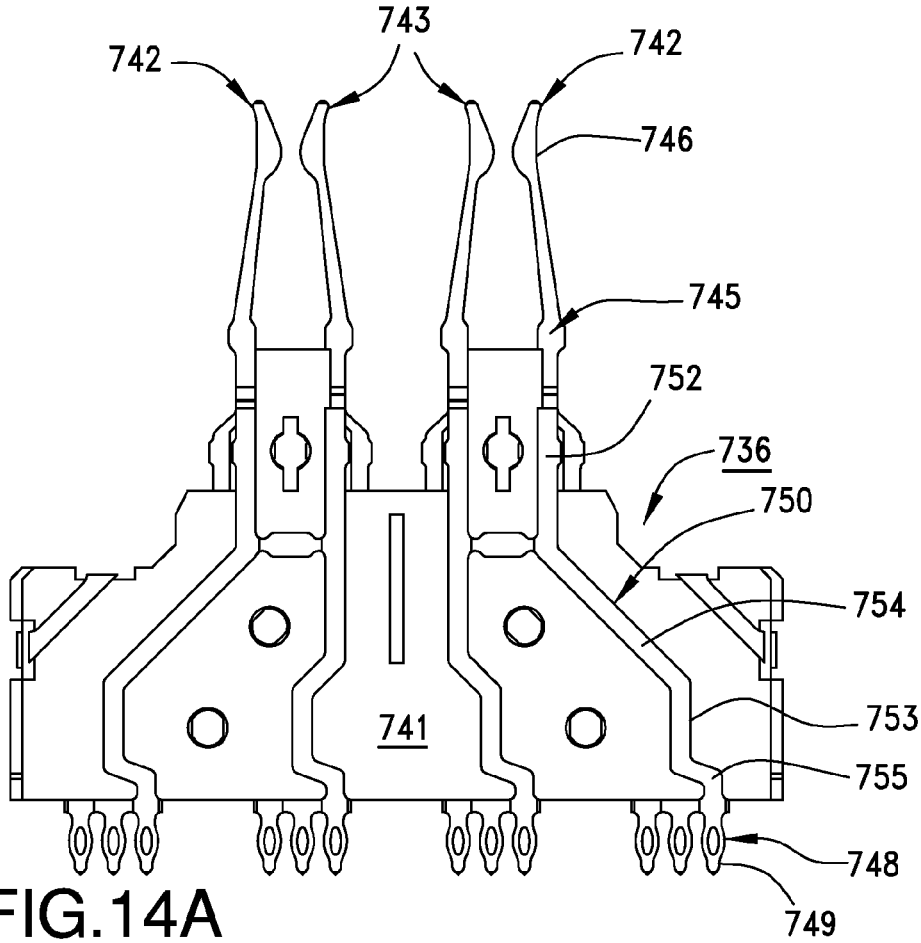
FIG. 14A is an elevational view of a first differential signal terminal assembly used in the connector assembly of FIG. 14.
Figure 14B:
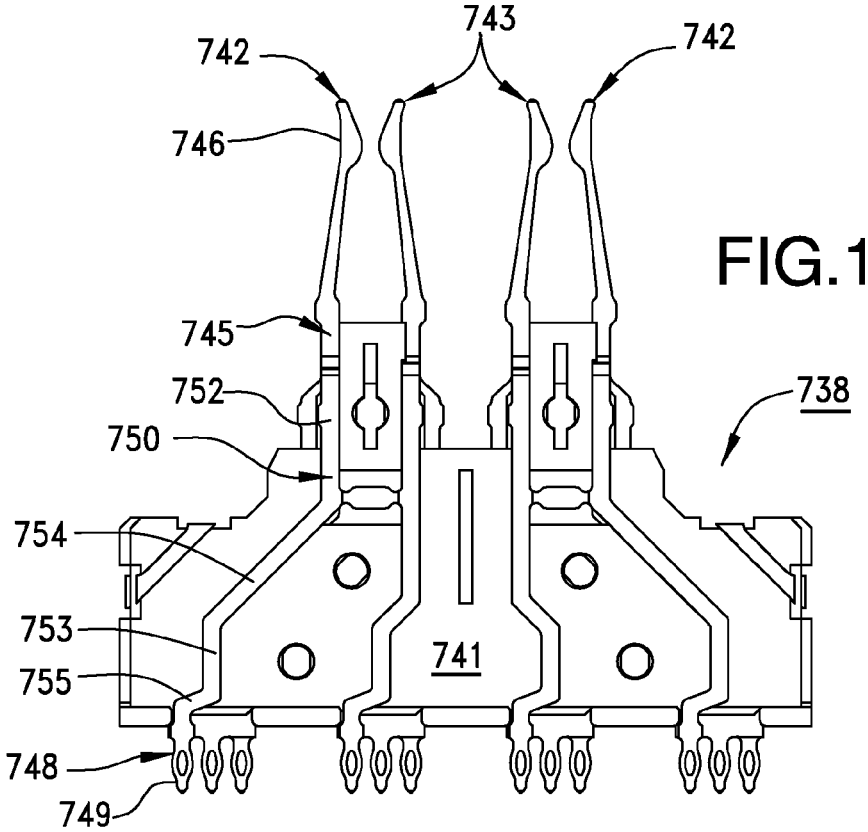
FIG. 14B is an elevational view of a second differential signal terminal assembly used in the connector assembly of FIG. 14 and positioned adjacent the terminal assembly of FIG. 14A to form multiple, broadside coupled, differential signal terminal pairs for use in the connector of FIG. 14.
Figure 14C:
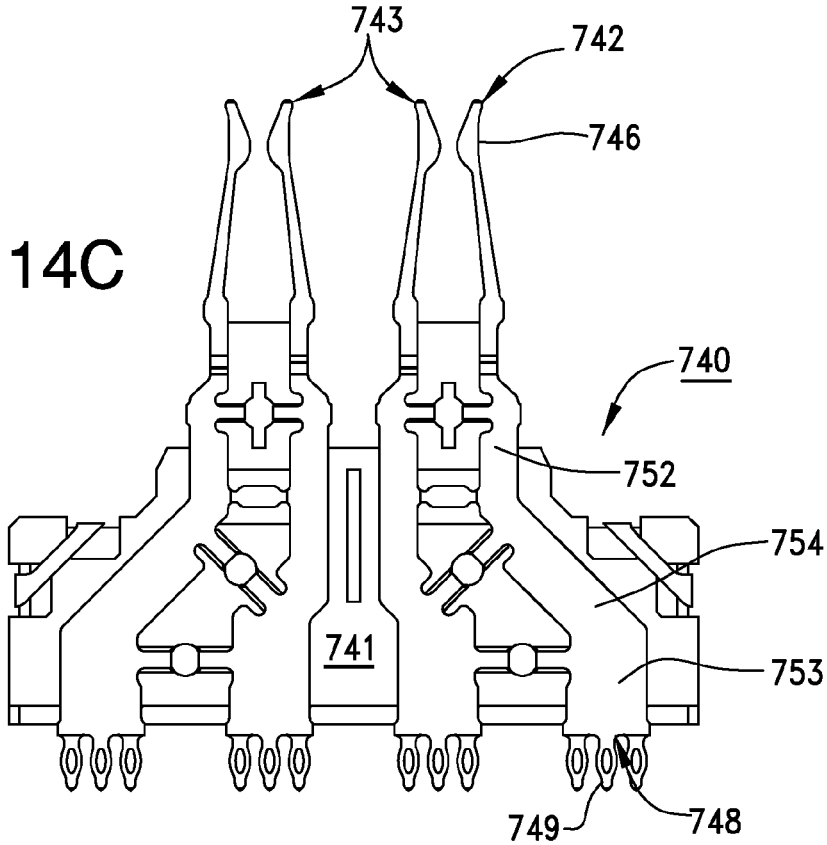
FIG. 14C is an elevational view of a ground terminal assembly used in the connector assembly of FIG. 14 and interposed between the differential signal terminal assembly pairs to provide isolation therefor.
Figure 14D:
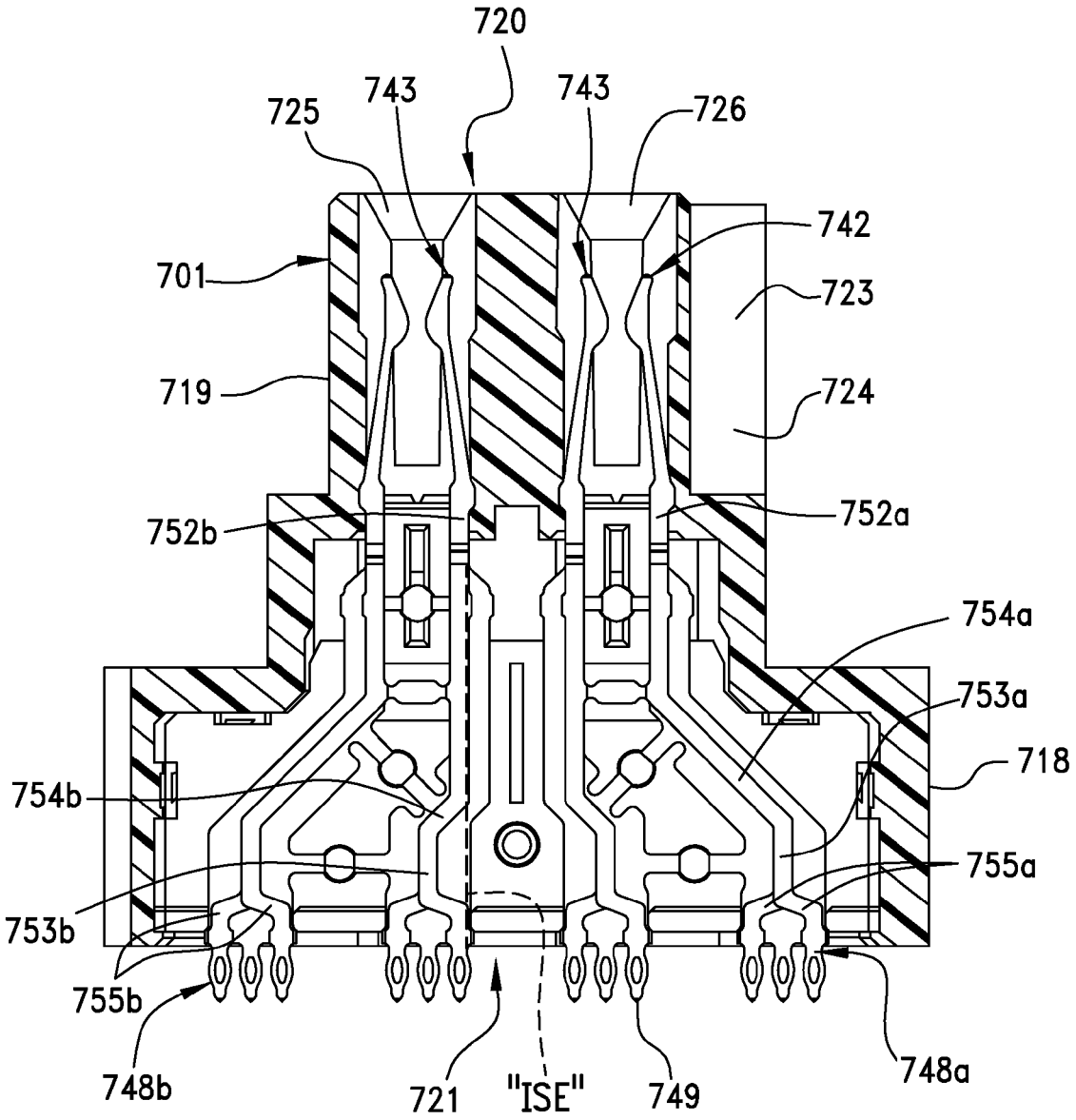
FIG. 14D is a sectional view of the connector of FIG. 12 with the wafers supporting the differential signal terminals of FIGS. 14A and 14B removed for clarity and to show their positioning with respect to each other, the ground terminals and the card-receiving slots of the connector.

As shown in FIGS. 14A, 14B and 14D, and as previously described with respect to the embodiment of FIGS. 1-3, the signal terminals of this connector 701 confront each other from their contact 746 through their first leg 752 to their jog 754. Eventually, at the second leg 753, the signal terminals diverge from their broad-side coupled relationship to an edge-coupled relationship and extend away from each other to the point where they meet reach a transition 755, and contact the circuit board 703 with their tail 748, which are shown as compliant pins 749. The signal terminal transition 755 of this embodiment is sized smaller than the signal terminal body transition portions 443 of the embodiment of FIGS. 1-3. It should be noted that the transition occurs in the signal terminals but is not as beneficial in the ground terminals, which are larger in size than the signal terminal. The transitions are used in the signal terminals for controlling the capacitance and resultant impedance and therefore need not be present in the ground terminals.

Figure 15:
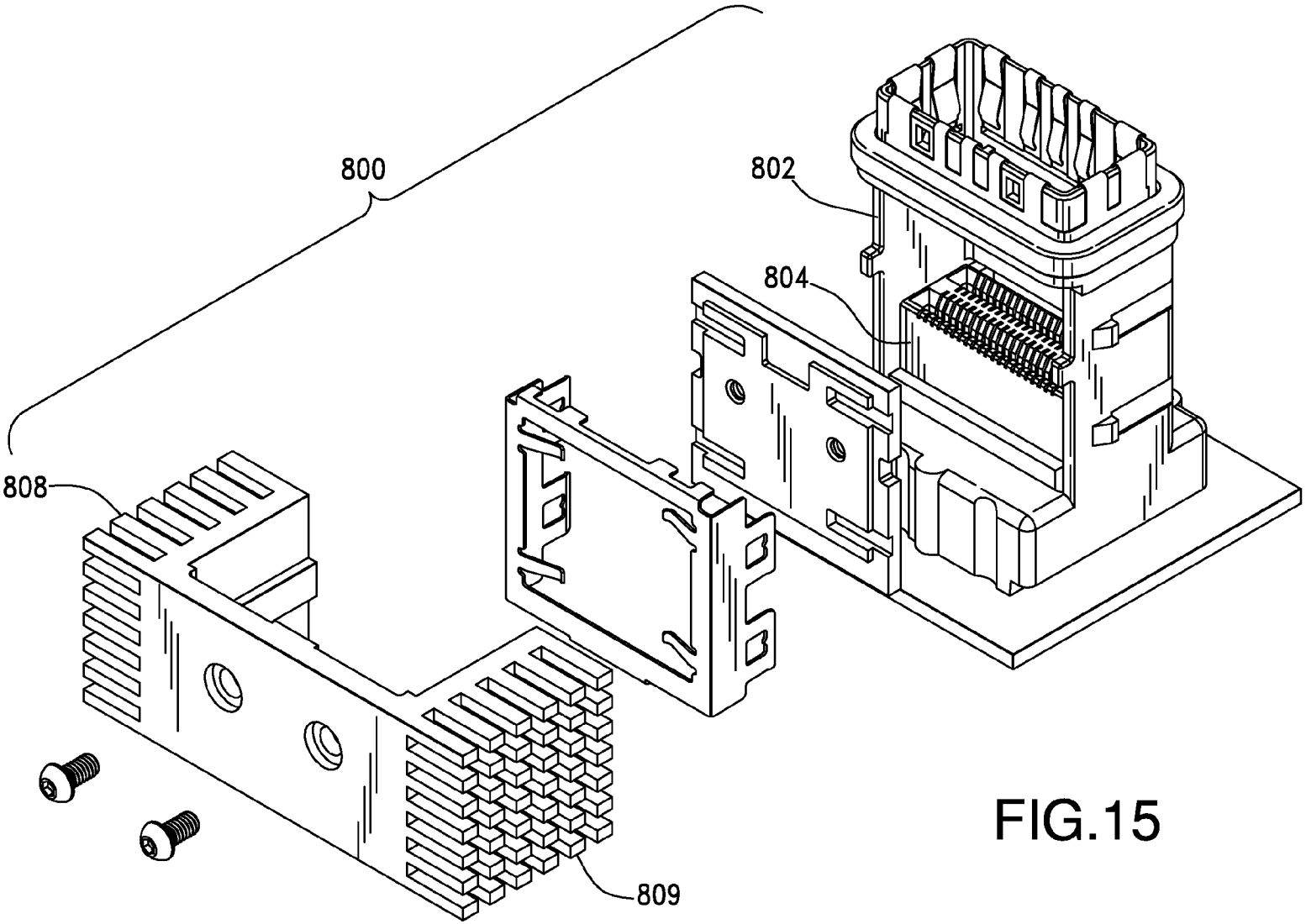
FIG. 15 is an exploded view of yet another connector assembly described in the disclosure with a different style of heat sink attached thereto.

As illustrated best in FIG. 14D, the outer arrays 742 of terminals have a first leg 752*a*, a jog 754*a*, a second leg 753*a*, a transition 755*a* and a tail 748*a* that extend away from the associated card slots, while the inner array have a first leg 752*b* and extend alongside one side of an imaginary extension of the card slots, and a jog 754*b*, a second leg portions 753*b* and at least part of the transition portions 755*b* extend into this location (e.g., the space beneath the card slots), as defined by the imaginary lines "ISE". Another embodiment of the connectors of this disclosure is illustrated in FIG. 15. In this embodiment, all of the interior components remains the same, namely the exterior guide housing 802 and the interior vertical connector 804, but the exterior heat sink 806 has a different structure, with two sets of heat dissipating members 808, 809 disposed on opposite sides of the heat sink 806. A separate spreader, or contact plate 810 can be used to ensure thermal conductivity between the heat sink 806 and an opposing plug connector inserted into the guide housing 802 and mated to the vertical connector 804.

Returning now to FIGS. 4-10, the connector housing 404 is provided with a pair of engagement members that are shown in the Figures as slots 436, 437 that are disposed on opposing sides of the nose 428 (FIG. 6), although they can be disposed on adjacent sides, if space permits. The engagement slots 436, 437 are preferably formed with an angular configuration to as to provide a dovetail when mated with complimentary engaging members 458, 459 of the surrounding guide frame 402. Although the engagement members 436, 437 are shown as slots 436, 437 that project from the nose 428 and along side the nose 428, terminating at the shoulders 462, it will be understood that such engagement members 436, 437 may take the form of projections, such as posts, or lugs. The sole means of engagement between the I/O connector 406 shown and the circuit board 407 is typically by way of the tail 417.

In order to facilitate connecting cable/plug connectors (not shown) to the connectors 404 an internal guide frame 402 is provided. As shown in FIG. 4, this guide frame 402 is a separate component that can be formed from a dielectric material, such as a plastic, and is formed with four sides 451-454 that are interconnected together as a single piece to define a general central opening 456 within the guide frame 402. This opening 456 accommodates and receives the nose portion 428 thereof.

As illustrated in FIG. 4, the guide frame 402 has two engagement members 458, 459 disposed thereon which are complimentary in configuration to the engagement slots 436, 437 of the connector housing 404, and also preferably are mortise-shaped projections in order to effect a reliable means of joining the two components together. A dovetail-like joining of the engagement members 458, 459 ensures a reliable engagement between the guide frame 402 and the connector housing 404, and prevents excessive horizontal movement between the two components.

Figure 7:
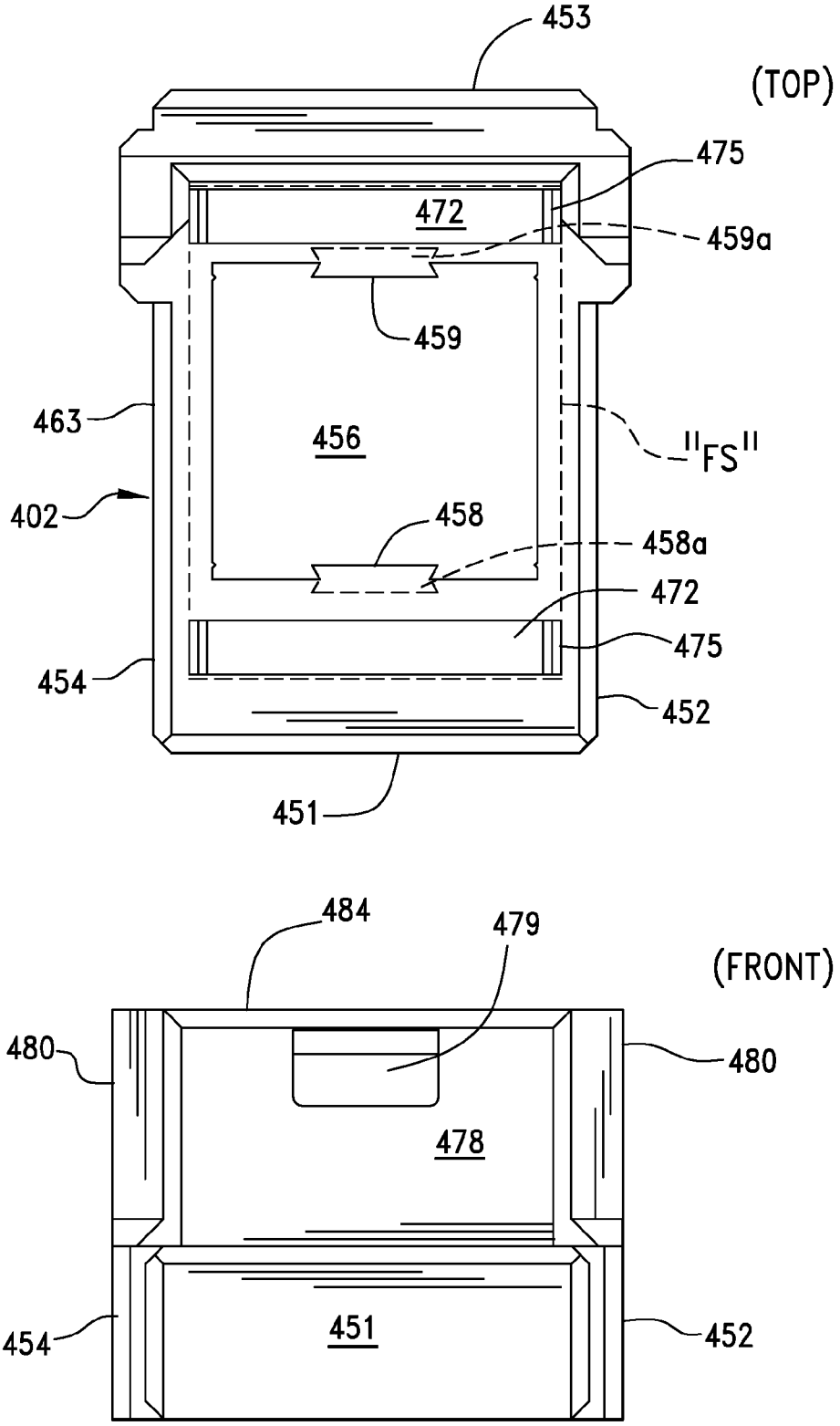
FIG. 7 is a top plan view of the guide frame of FIG. 6, illustrating an alternate means for engaging the vertical connector.
Figure 8:
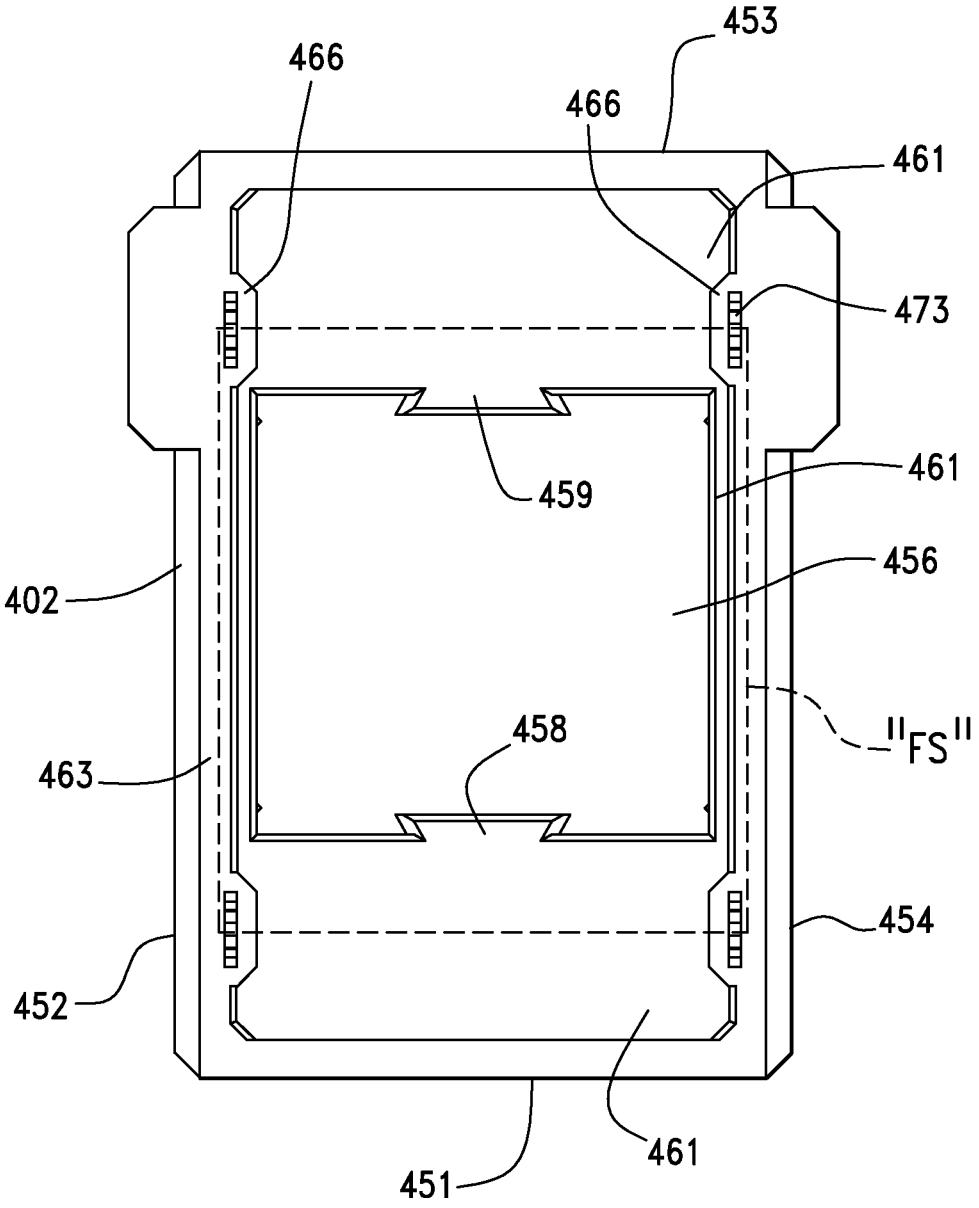
FIG. 8 is a bottom plan view of the guide frame of FIG. 7.

The guide frame 402 has a hollow interior portion 460 that extends alongside the opening 456 and is larger in size than the opening and defines an inner ledge, or recess 461, in the guide frame 402 (preferably with a flat bottom surface so that it rests on and abuts the connector housing exterior shoulders 462). This inner recess 461 is defined by a skirt 463 that extends completely around the opening 456 as illustrated, in order to match the extent to which the shoulder 462 extend around the nose 428. The base 430 may also include a plurality of vertical recesses 464 arranged on apexes of an imaginary four-sided figure "FS" that enclose the guide frame opening 456, as shown in FIG. 7. In the embodiment illustrated, the four-sided figure takes the form of a rectangle. The recesses 464 receive like projections 466 that are disposed along the interior ledge 461 of the guide frame 402. Although the engagement between the connector housing 404 and the guide frame 402 is reliable, the connector, without more, is secured to the circuit board 407 only by way of the tail 417 of its terminals 416. As such, insertion and removal forces generated by connecting or disconnecting a cable/plug connector to or form the connector housing 404 may be transferred to the terminal tails 417 and could cause them to work loose. Additionally, if the opposing mating connector is tilted during connection or disconnection, torsional forces may be applied to the terminal tail portions 417.

Accordingly, the guide frame 402 can be provided with a means for directly engaging the circuit board 407 which reduces the likelihood of detrimental force transfer to the terminal tail portions 417 of the connector 406. This is shown as a pair of U-shaped retention straps 468 which extend downwardly through the sides 452, 454 of the guide frame 402 and within portions of the guide frame inner projections 466. The straps 468 can be seen to have a backbone 468*a* and two arms 468*b* joined thereto, with the backbone portion 468*a* being received in a channel 472 of the guide frame 450 and the free end of the arm 468*b* including a tail portion 473 that is received in a hole 474 in the circuit board 407. Similarly, the arm 468*b* of the retention strap 468 is received in and extends through slots 475 that are formed in the guide frame 402. The tails 473 of the retention straps 468 may be soldered, or otherwise attached, to the circuit board 407.

As depicted, the guide frame 450 does not extend down alongside of the connector housing 404 and into contact with the circuit board 407. Rather, the bottom of the guide frame skirt 463 is spaced away from and above the circuit board 407. This maintains the footprint of the housing 404 and leaves open that area of the circuit board 407 for circuit traces and other components. The straps 468 extend within the corresponding side recesses 464 of the connector housing 404 as do the strap tails 473. The tail 473 are preferably soldered to the circuit board 407 to provide a secondary means of retaining the entire assembly 400 in place on the circuit board. As can be appreciated, such a configuration takes us much less board space than would an alternative method that used mounting screws or other such fasteners.

The guide frame 402 includes a latch wall 478 to which a latching element of an opposing connector may connect. The latch wall 478 has a slot 479 formed therein near the top edge 484 of the wall 478. The latch wall shown 478 has two end walls 480 which extend in an offset manner therefrom, so that when viewed from the top, as shown in FIG. 4, it presents a somewhat flattened U-shaped configuration. These end walls 480 cooperate with the latch wall 478 to form a channel with the intervening space 482 that occurs between the latch wall 478 and the connector nose portion 428. This space 482 accommodates an exterior guide flange or housing of an opposing mating connector.

Figure 9:
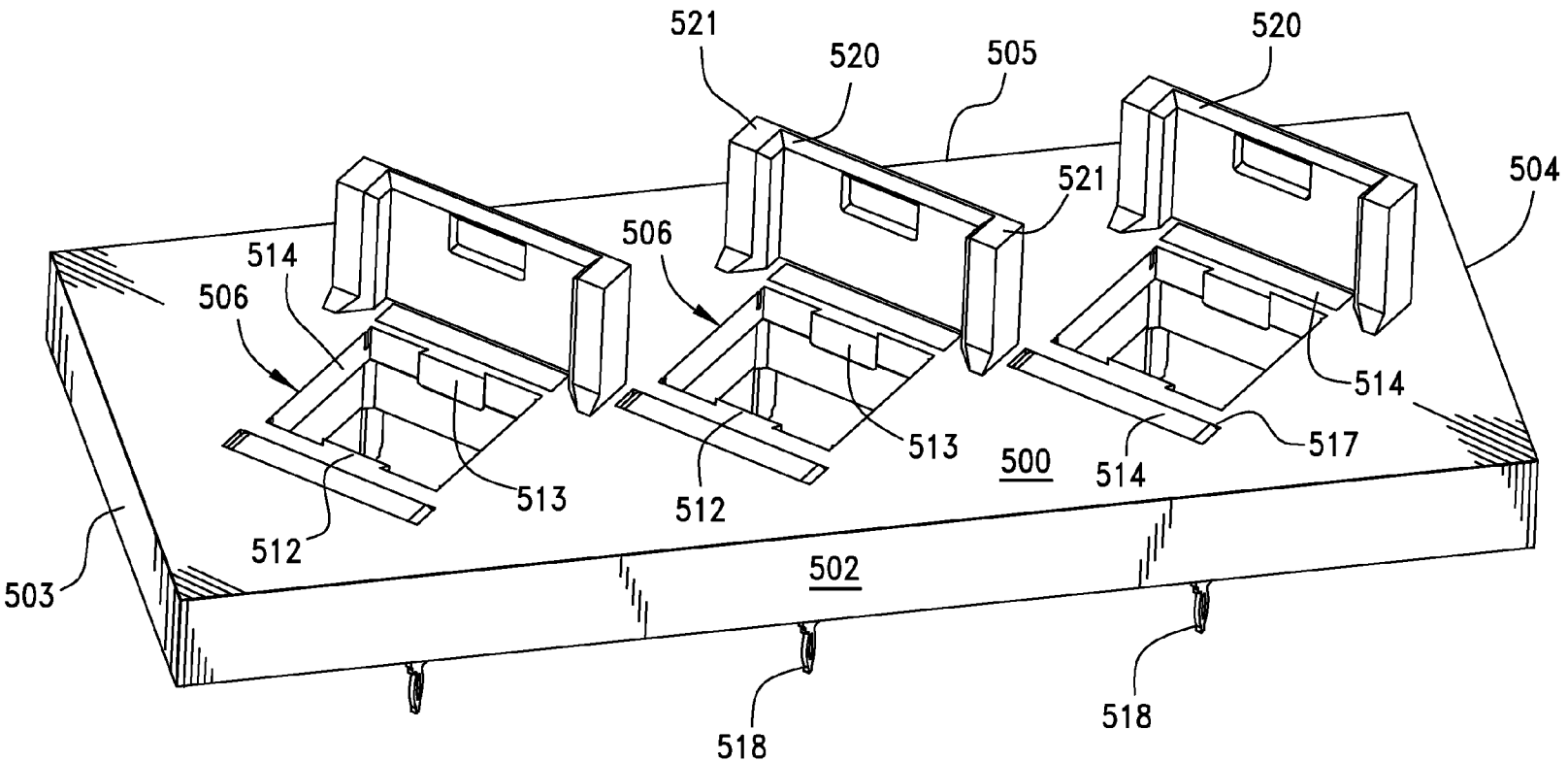
FIG. 9 is a perspective view of an alternate embodiment of a guide frame assembly for vertical connectors that is suitable for ganged applications.

FIG. 9 illustrates an alternate embodiment of a guide frame 500 that is suitable for ganged applications where the guide frame 500 is placed over multiple vertical connectors. The guide frame has four sides, 502, 503, 504, 505 and multiple openings 506 formed in its body portion. These openings are configured to slip over nose portions of a plurality of vertical connectors similar to the connector 406. These openings 506 are angled with respect to the sides of the guide frame 500 so that they may accommodate angled mountings of their associated connectors 406 on the circuit board 407, or an angled orientation of the guide frame 500 with respect to the connectors 406. Whereas in the previous embodiment, the sides of the guide frame 402 were aligned with the sides of the connector 406, in this embodiment, the sides of the connectors and the guide frame 500 are not so aligned. Rather, they are oriented at angles with respect to each other.

As illustrated, the guide frame 500 has a plurality of interior recesses 510, one such recess 510 being associated with each opening 506. These recesses 510 extend around each opening 506 and are larger than the openings so that the entire guide frame 500 acts as a single skirt that contacts the opposing shoulder portions of the connectors and surrounds the nose portions of the connectors. The guide frame 500 includes engagement members 512, 513 disposed on inner surfaces 514 of the openings 506. Retention straps 514 are provided and include leg portions 516 that extend through the body of the guide frame 500 outside the perimeter of the openings 506, and as above, these straps 514 terminate in tails 518 that are received in openings in the circuit board. The straps 514 may also be received in recesses 517 formed in the guide frame proximate to the openings 506.

A latch wall, 520 is provided for each opening 506 and rises above the plane of the guide frame body in alignment with and spaced apart from the opening 506 so as to define a channel into which a mating or guide flange of an opposing mating connector may extend. End walls 521 may be provided at opposite ends of the latch wall 520.

Figure 10:
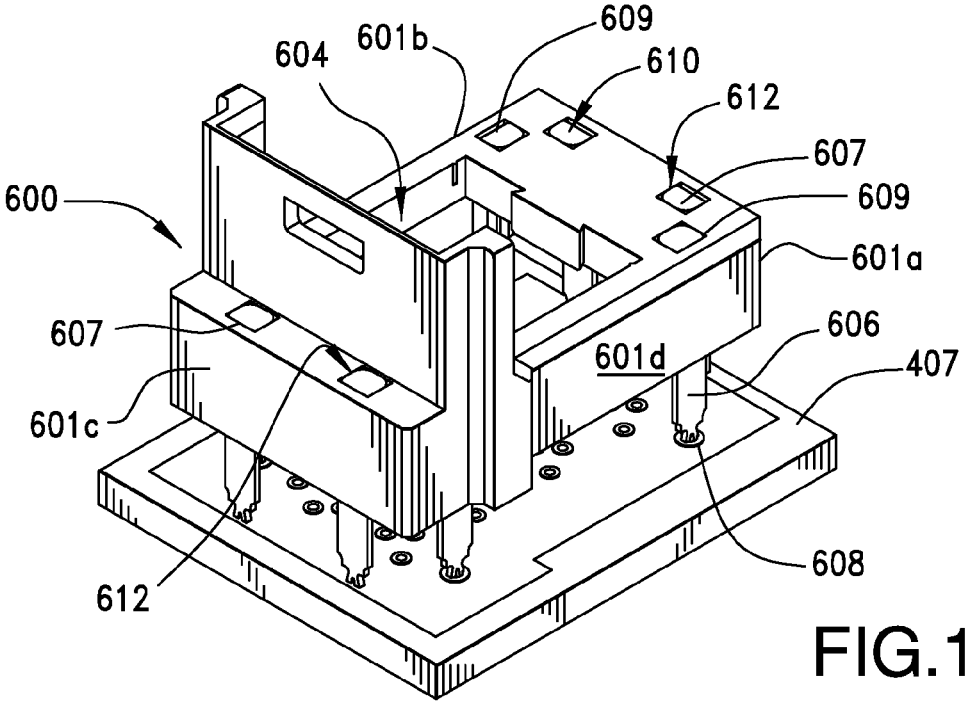
FIG. 10 is a perspective view, taken from the rear thereof, of another embodiment of a guide frame for use with a vertical connector and for engaging a circuit board.
Figure 11:
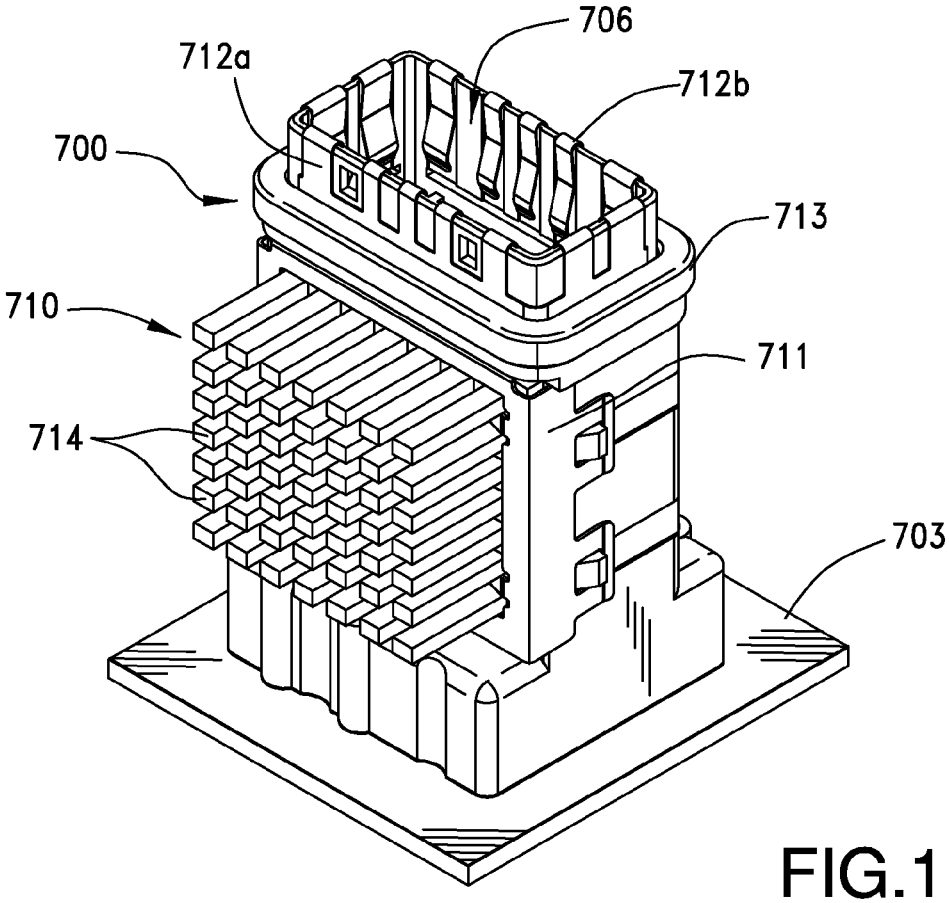
FIG. 11 is a perspective view of another embodiment of a vertical connector assembly of the disclosure, which is used in association with an exterior heat sink.
Figure 12:
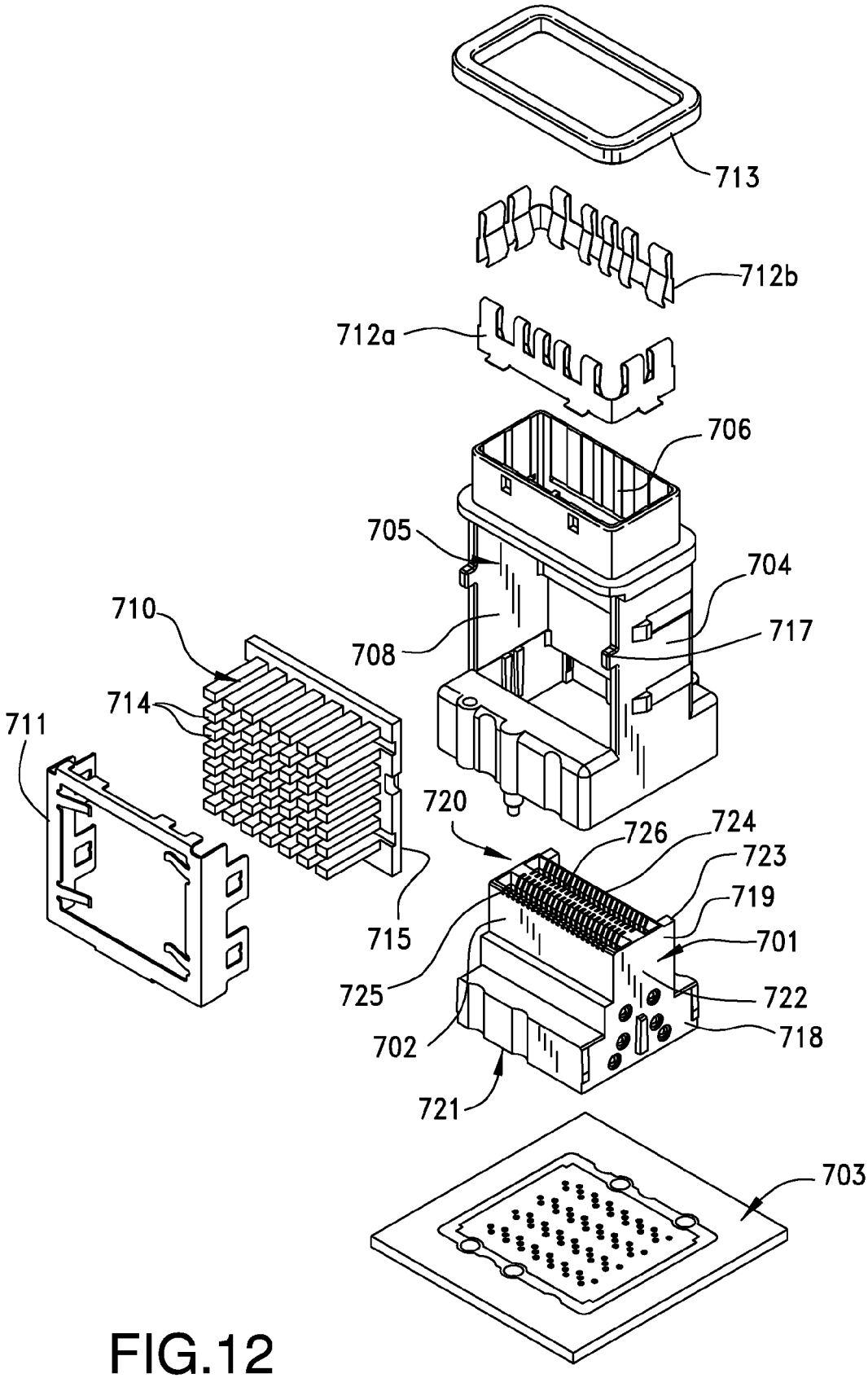
FIG. 12 is an exploded view of the connector assembly of FIG. 11.
Figure 13:
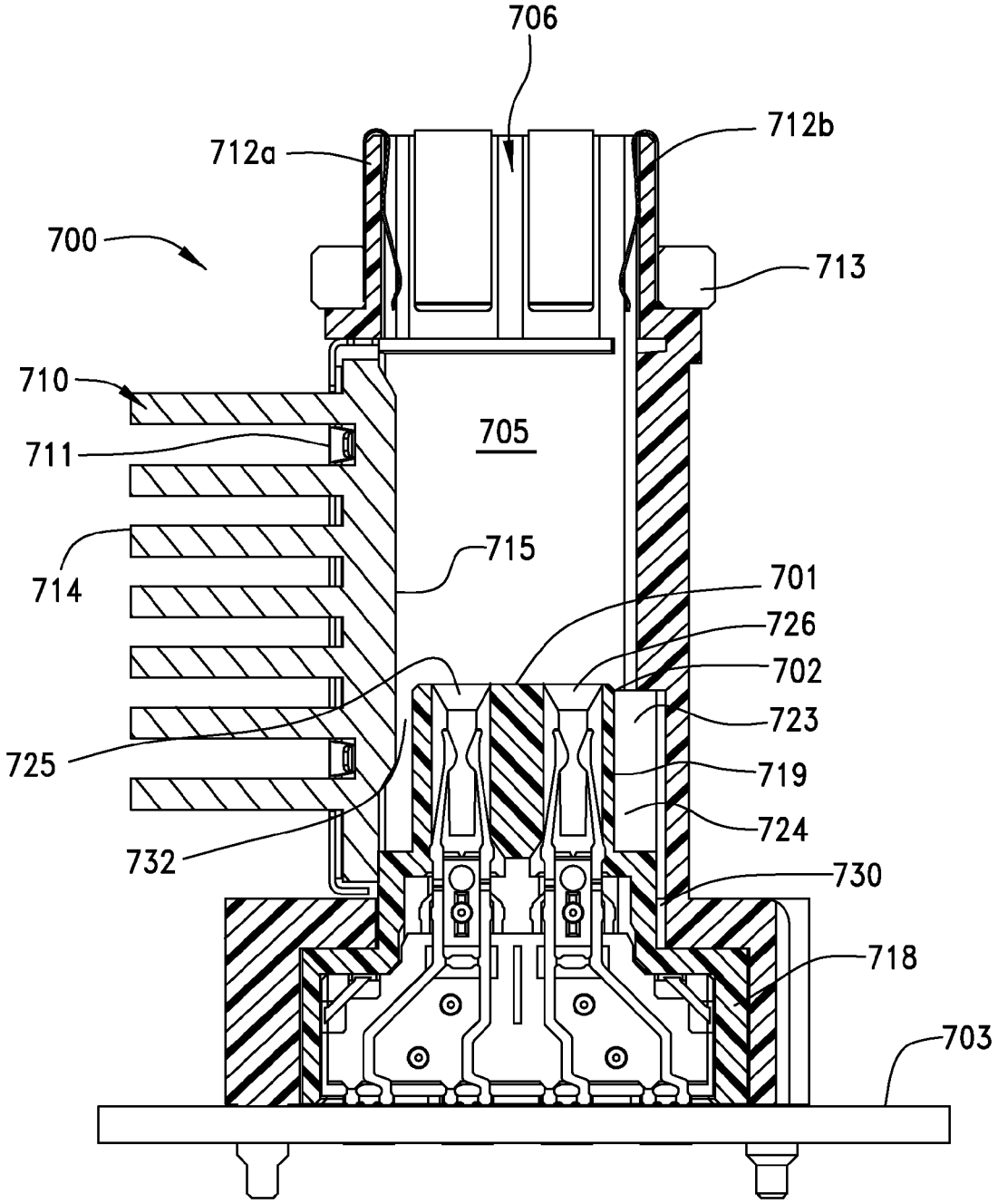
FIG. 13 is a sectional view of the connector assembly of FIG. 12, taken generally along lines 13-13 thereof and illustrating the connector in place within the guide housing and the exterior heat sink and further illustrating two guide channels defined by the three components.

Yet another embodiment of the vertical connector guide frame is shown, generally at 600 in FIG. 10 where an individual guide frame 600 includes four sides 601*a-c* and an opening 604 within the perimeter of the guide frame body portion 603 is shown. As depicted, the guide frame 600 does not rely upon retention straps, but rather, utilizes a plurality of individual retention members 610 that are received in slots 602 formed in the body portion 603 outside the perimeter of the opening 604. These retention members 610 have a general inverted L-shaped configuration, with an elongated leg portion 606 that terminates at one end thereof in a tab 607 and at the other end thereof in a tail 608. The tails 608 are received in corresponding slots 609, each of which has a small recess 612 communicating with it such that the retention member leg portions 606 extend through the slots 609 and the tab portions 607 are received in the recesses 612. The retention members 610 are further preferably arranged so that two such members are disposed on each side of the guide frame 600, and they may be aligned as shown, within the boundaries of the specific side as well as with the retention members on the side opposite the guide frame opening.

The guide frame 600 also includes an interior recess 614 adjacent to and communicating with the opening 604 which assists in defining the skirt portion of the guide frame and which contacts the opposing shoulders of the vertical connector 404. This interior recess 614 extends adjacent to the retention members 610. The leg portions 606 of four of the retention members extend through the left and right sides 601*b*, 601*d* of the guide frame 600 and in projections 616 extending into the opening along inner sides of the openings. These projections are slotted with an opening 618 that runs vertically down them to facilitate pushing the retention members 610 into and through them. The other four retention members 610 that are arrayed along the front and back sides of the opening 604 and may be received within vertical channels 620 formed in the inner surfaces of the guide frame. In this embodiment, the retention members 610 are moved closer to the front and rear sides 601*a*, 601*c* (other distanced from the opening 604) than as with the retention straps as shown in FIG. 4.

Figure 16A:
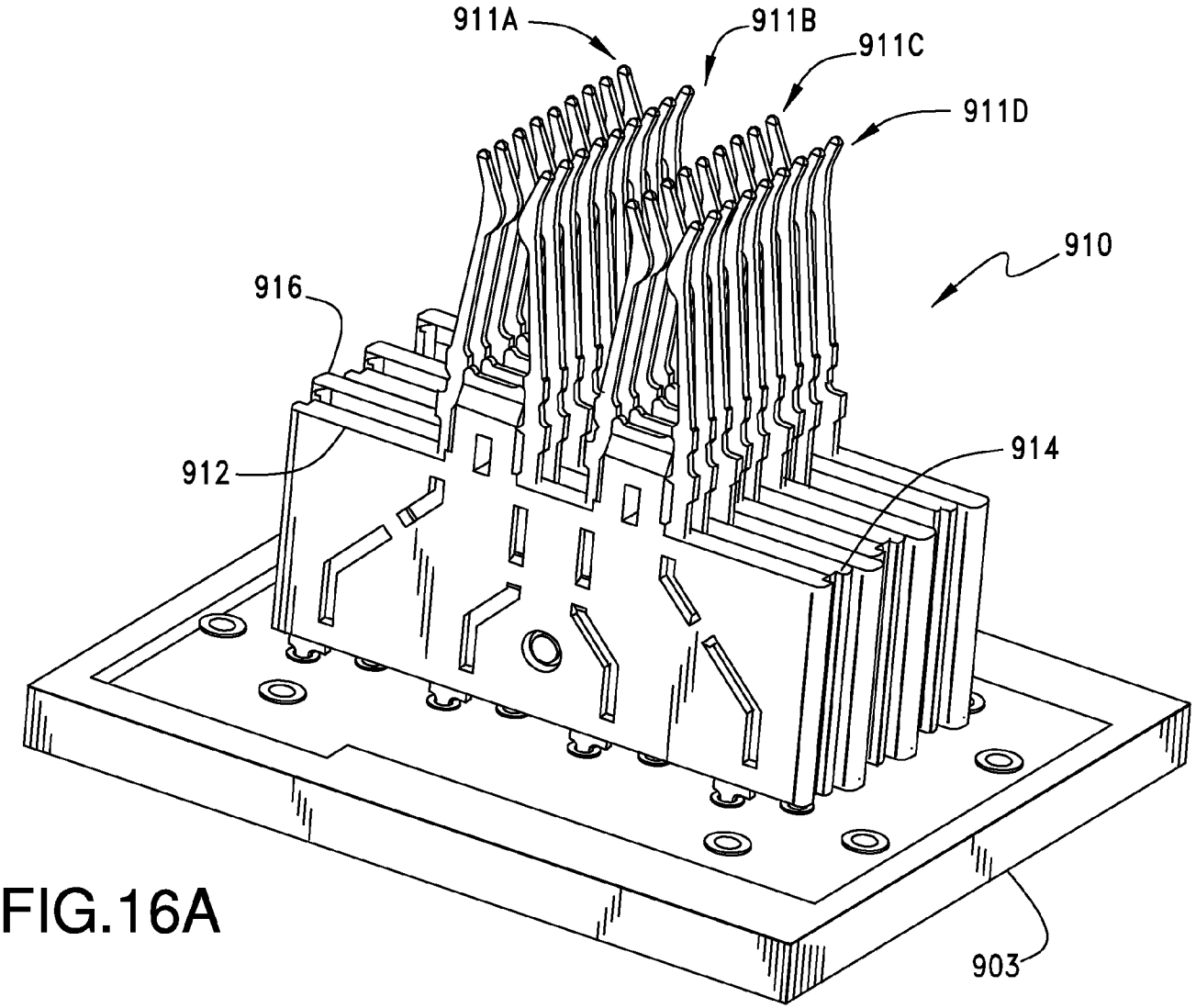
FIG. 16A is a perspective view of an array of wafers.
Figure 16B:
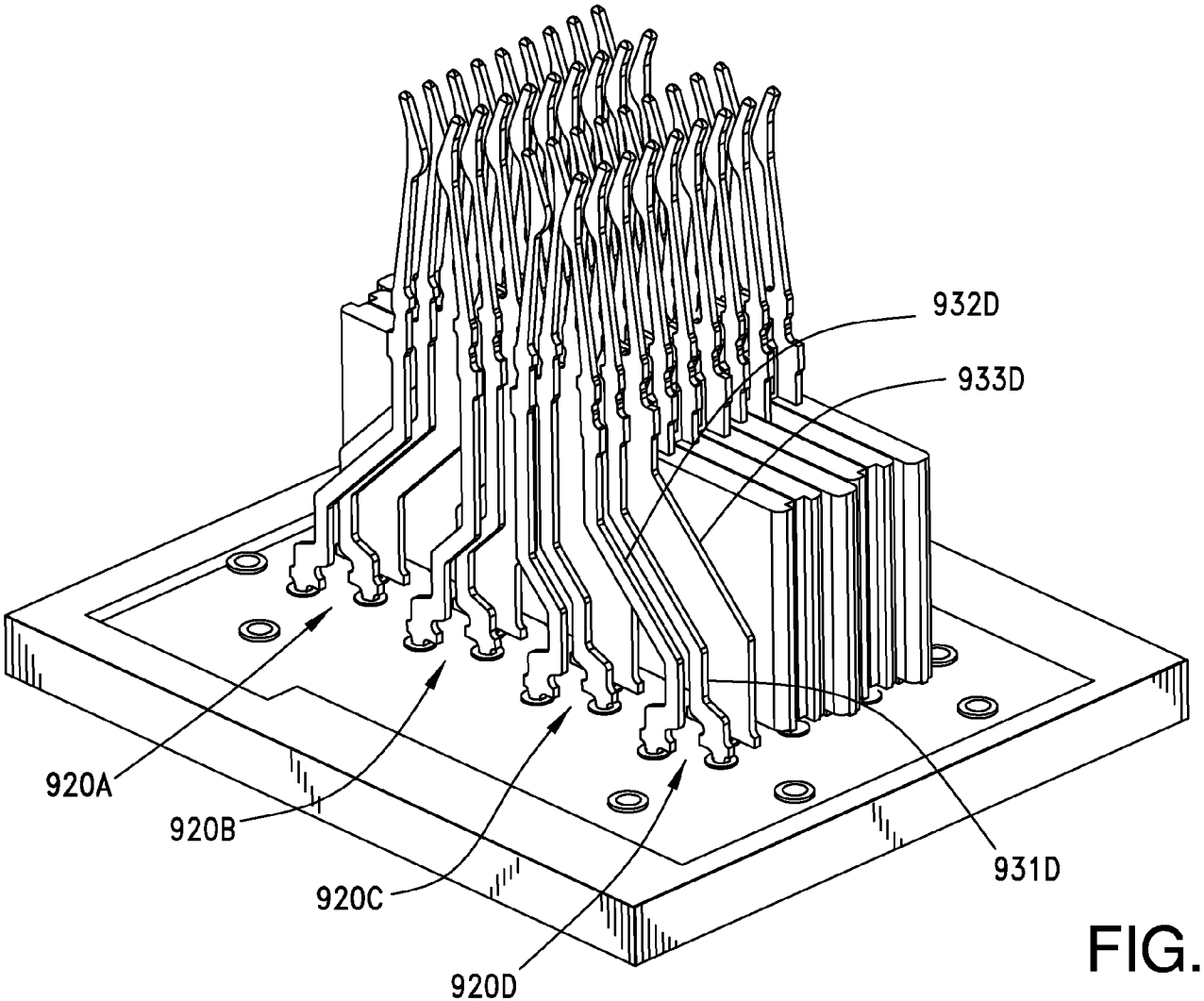
FIG. 16B is a simplified partial perspective view of a terminals positioned in the array depicted in FIG. 16A.
Figure 16C:
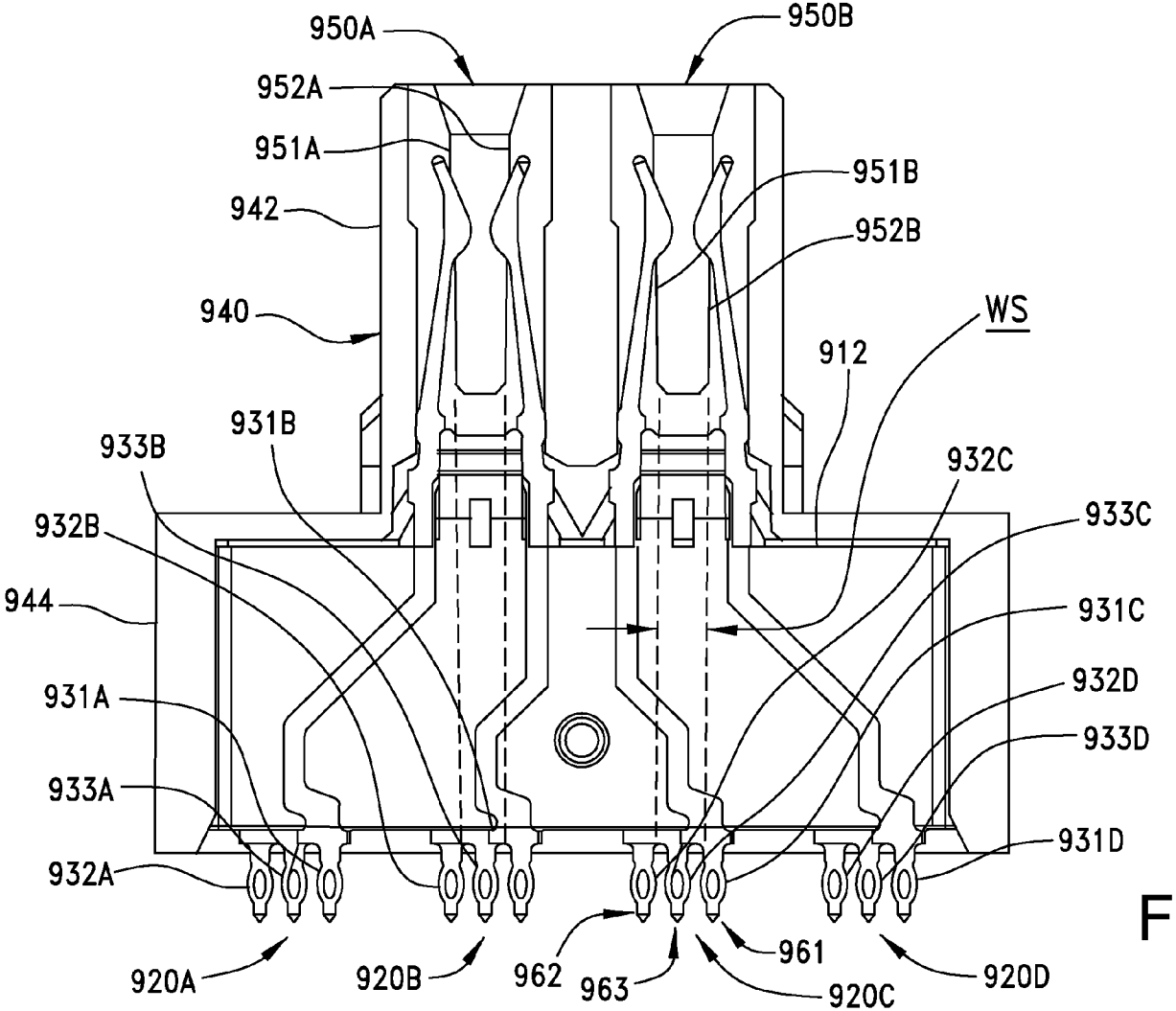
FIG. 16C is an elevated side view of a cross-section of the array depicted in FIG. 16A but with a housing added.

FIG. 16A-16C, while depicting an embodiment similar to that disclosed in FIGS. 1-8, are provided to illustrate additional features that can be provided in a vertical connector. Thus, while the labels used in FIGS. 16A-16C are different than those used above, it is intended that the noted features be considered possible features of the above noted embodiments.

As depicted, a circuit board 903 supports an array of wafers 910 that can be positioned in a housing 940 that includes a base 944 and a nose 942. Each wafer 912, 914, 916 supports a pair of terminals that is positioned in a slot 950A, 950B. The array of wafers 910 thus provides a terminal row 911A and a terminal row 911B in slot 950A and terminal row 911C and terminal row 911D in slot 950B. To provide desirable routing and electrical performance, the tails are also provided in a tail row 920A, 920B, 920C, 920D on the circuit board.

As can be appreciated, the tail rows 920A-920D are respectively made up of terminals 931A, 932A, 933A-931D, 932D, 933D. Thus, as illustrated, the terminals used in wafers follow a signal, signal, ground pattern. As can be appreciated, the depicted embodiment allows for high density and high data rates. Notably, wafers 912, 914 are configured to provide signal terminals that form a differential pair and wafer 916 is configured to provide a ground terminal between adjacent differential pairs. This pattern can be repeated so that large number of differential pairs can be provided in a given space, Alternatively, some of the terminals could be used for other purposes (such as power or low data-rate signaling) and might have a different shape. The depicted terminals and wafer configuration, however, provide a differentially coupled signal pair that can enable data rates of greater than 10 Gbps with conventional crosstalk and return loss levels (e.g., allow for acceptable channel performance at greater than 10 Gbps channel data rates). However, if the ground terminals are pinned, as shown above, the depicted configuration will allow data rates of greater than 20 Gbps. For example, in simulation, the illustrated design with pins provides far-end crosstalk at levels of below 40 dB out beyond 15 GHz. In addition, insertion loss is relatively linear and less than 1.5 dB out to about 15 GHz and return loss is below 10 dB out to about 13 GHz.

As the two slots 950A and 950B are adjacent, the slots 950A, 950B also have adjacent tail rows 920B, 920C. As noted above, each slot can be aligned with one of the tail rows (950*a* with 920B and 950B with 920C). In an embodiment, the slot and tail rows can be configured so that the both of the adjacent tail rows has at least on terminal positioned within a space WS defined by defined by the two opposing walls 951A,952A and 951B,952B of the slots. It has been determined that, if a three tail position tail row is used (e.g., the first tail is in a first position 961, the second tail is in a second position 962 and the third tail is in a third position 963, as shown) further benefits from a system level standpoint can be obtained if the third position 963 is aligned with the space WS. Specifically, this allows for acceptable routing layout on the circuit board while providing a dense arrangement that doesn't use excessive board space.

It should be noted that while detailed features regarding embodiments of guide frames have been disclosed, these features are not intended to be limiting unless otherwise noted. It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the art to which this invention relates and are intended to be within the scope of the claims, which follow. It is noted, as is conventional, the use of a singular element in a claim is intended to cover one or more of such an element.

What is claimed is:

1. An electrical connector, comprising:

a housing having a base with a mounting face and a nose extending from the base, the nose including a mating face with two slots disposed therein, each slot including first and second sides; and a plurality of conductive terminals arranged in first and second arrays respectively disposed along the first and second side of each slot, each array including at least two signal terminals that form a differential signal pair, the signal terminals including a contact disposed in the slot, a tail disposed proximate to the mounting face, and a body interconnecting the contact and tail together, the body further including a first and second leg extending within the housing and spaced apart from each other, and a jog interconnecting the first and second leg, the jog extending at an angle to the first and second leg, wherein the jog of the first array extends in a first direction away from the card slot first side, and the jog of the second array extends in the first direction such that a portion of the second array second leg extends beneath the slot, wherein the terminals are positioned in a first and second signal wafer and the terminals in the first and second signal wafer are broad-side coupled from the contact to the second leg so as to form differentially coupled signal pairs within the first and second wafer.

2. The connector of claim 1, wherein the body of the signal terminals in the first and second array includes a transition disposed between the second leg and the tail.

3. The connector of claim 2, wherein the connector includes an axis of symmetry extending between the two slots.

4. The connector of claim 2, wherein the second leg has a first width and the transition has a width that is greater than the first width.

5. The connector of claim 1, wherein at least portions of the second array jog also extends beneath the slot.

6. The connector of claim 1, wherein the tails of each differential signal pair are spaced apart from each other in both longitudinal and lateral directions.

7. The connector of claim 1, wherein the jog of the first array has a first length and the jog of the second array has a second length that is less than the first length.

8. The connector of claim 1, wherein at least portions of the second leg are disposed within an imaginary extension of the slot formed by extending imaginary lines from the slot to the mounting face.

9. The connector of claim 8, wherein at least portions of the second array jog and second leg are disposed within the imaginary extension of the slot.

10. An electrical connector, comprising:

a housing having a base with a mounting face configured to be mounted on a circuit board and a nose extending from the base, the nose including a mating face with two slots disposed therein, the slots providing openings that are configured to receive mating projections inserted in a direction perpendicular to the circuit board, each slot including first and second sides;

a plurality of wafers supported by the housing; and a plurality of conductive terminals supported by the plurality of wafers and arranged in first and second arrays respectively disposed along the first and second side of each slot, each array including at least two signal terminals that form a differential signal pair, the signal terminals including a contact disposed in the slot, a tail disposed proximate to the mounting face, and a body interconnecting the contact and tail together, wherein the terminals that form the differential signal pair are positioned in adjacent wafers and the terminals in the adjacent wafers are broad-side coupled at the contact so as to form differentially coupled signal pairs within the adjacent wafers.

11. The electrical connector of claim 10, wherein the plurality of terminals support at least two differential signal pairs, each of the terminals that form the differential signal pairs being positioned in different wafers and wherein at least one ground terminal is positioned between the two differential signal pairs, the ground terminal being positioned in a wafer separate from the wafers that support the terminals that form the differential pairs.

12. The electrical connector of claim 10, wherein the tails of the terminals that form the differential pair are spaced apart from each other in both longitudinal and lateral directions.

13. The electrical connector of claim 10, wherein the slots have channels and the terminals that form the differential signal pair are positioned in adjacent channels.

14. The electrical connector of claim 10, wherein each of the adjacent wafers supports four terminals, each of the four terminals positioned on a side of one of the two slots so as to provide two terminals on opposite sides of one slot and two terminals on opposite sides of the other slot.

15. The electrical connector of claim 14, wherein the bodies of the terminals in the adjacent wafers are aligned so as to form four broad-side coupled differential pairs positioned in four rows.

16. The electrical connector of claim 15, wherein the tails of terminals that form the broad-side coupled differential pairs are offset transversely from the corresponding row.

* * * * *